US010267189B2

(12) United States Patent
Takehana et al.

(10) Patent No.: US 10,267,189 B2
(45) Date of Patent: Apr. 23, 2019

(54) VARIABLE VALVE ACTUATION DEVICE FOR INTERNAL COMBUSTION ENGINE

(71) Applicant: HONDA MOTOR CO., LTD., Tokyo (JP)

(72) Inventors: Kaori Takehana, Wako (JP); Yukio Konishi, Wako (JP); Chikara Tanaka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/833,433

(22) Filed: Dec. 6, 2017

(65) Prior Publication Data

US 2018/0179922 A1 Jun. 28, 2018

(30) Foreign Application Priority Data

Dec. 27, 2016 (JP) ..... 2016-254052

(51) Int. Cl.

| | |
|---|---|
| ***F01L 1/14*** | (2006.01) |
| ***F01L 13/00*** | (2006.01) |
| ***F01L 1/18*** | (2006.01) |
| ***F01L 1/24*** | (2006.01) |
| *F01L 1/46* | (2006.01) |

(52) U.S. Cl.

CPC ..... *F01L 13/0036* (2013.01); *F01L 1/143* (2013.01); *F01L 1/185* (2013.01); *F01L 1/2405* (2013.01); *F01L 13/0005* (2013.01); *F01L 2001/467* (2013.01); *F01L 2105/00* (2013.01); *F01L 2107/00* (2013.01)

(58) Field of Classification Search

CPC ..... F01L 1/143; F01L 1/185; F01L 1/2405; F01L 13/0036; F01L 2107/00

USPC ..... 123/90.16, 90.39, 90.44, 90.48, 90.55

See application file for complete search history.

(56) References Cited

U.S. PATENT DOCUMENTS 6,302,070 B1 10/2001 Tsukui et al.
10,132,207 B2 * 11/2018 Takehana et al. .... F01L 1/2411 123/90.39

FOREIGN PATENT DOCUMENTS

JP 2011185092 A 9/2011

* cited by examiner

*Primary Examiner* — Ching Chang
(74) *Attorney, Agent, or Firm* — Armstrong Teasdale LLP

(57) ABSTRACT

A variable valve actuation device includes a plurality of valve lifter. Each valve lifter slidable in a lifter support hole between an upper position and a lower position. A valve rest recess communicating with a valve rest chamber opens out at an outer circumferential surface of the valve lifter, and a valve rest supply port of a valve rest passage opens out at an inner circumferential surface of the lifter support hole in such a positional relationship that the valve rest passage and the valve rest chamber communicate with each other when the valve lifter is at the upper position, and continue to communicate with each other until the valve lifter has moved downward to a shut-off position located at a prescribed part of a down stroke from the upper position. The communication between the valve rest passage and the valve rest chamber shut off at the shut-off position.

16 Claims, 16 Drawing Sheets base position
(zero stroke)

intermediate position
(shut-off position)

lowermost position
(full stroke)

base position
(zero stroke)

intermediate position
(shut-off position)

lowermost position
(full stroke)

VARIABLE VALVE ACTUATION DEVICE FOR INTERNAL COMBUSTION ENGINE

TECHNICAL FIELD

The present invention relates to a variable valve actuation device for an internal combustion engine capable of changing the lift characteristics of an engine valve provided in an intake passage and/or an exhaust passage formed in a cylinder head.

BACKGROUND ART

Various mechanisms have been proposed as devices for changing the lift characteristics of intake and exhaust valves of an internal combustion engine. U.S. Pat. No. 6,302,070B1 and JP2011-185092A disclose a valve rest mechanism in which a valve lifter is interposed between each valve and the corresponding valve actuation cam, and a slide pin configured to be hydraulically and selectively actuated is incorporated in the valve lifter.

In such a valve rest mechanism, the valve lifter internally defines a slide hole extending in a diametric direction, and a slide pin is slidably received in the slide hole. The slide pin can be axially actuated by hydraulic pressure applied to one of the axial end of the slide pin, and a return spring is provided on the other axial end of the slide pin. The lower side of the slide pin is formed with a flat abutting surface, and a receiving hole is formed in a part of the abutting surface. By controlling the hydraulic pressure supplied to the one end of the slide pin, the slide pin can move between a valve operating position where the stem end of the engine valve abuts the abutting surface of the slide pin, and a valve rest position where the stem end of the engine valve is received in the receiving hole.

In the valve rest mechanism disclosed in U.S. Pat. No. 6,302,070B1, when the hydraulic pressure is not applied to the one end of the slide pin (at low pressure), the stem end of the valve stem is received in the receiving hole of the slide pin so that the engine valve does not open as the valve lifter moves downward. When the hydraulic pressure is supplied to the one end of the slide pin, the stem end of the valve stem comes into contact with the abutting surface of the slide pin as the valve lifter moves downward so that the engine valve opens. In the valve rest mechanism disclosed in JP2011-185092A, when the hydraulic pressure is not applied to the one end of the slide pin (at low pressure), the stem end of the valve stem comes into contact with the abutting surface of the slide pin as the valve lifter moves downward so that the engine valve opens. When the hydraulic pressure is supplied to the one end of the slide pin, the stem end of the valve stem is received in the receiving hole of the slide pin so that the engine valve does not open as the valve lifter moves downward.

Such valve rest mechanisms are typically applied to multi-cylinder engines. In such a case, the hydraulic pressure for the valve rest mechanisms of the different cylinders are not individually controlled, but is commonly controlled. Therefore, when the hydraulic pressure is switched over between a valve operating state and the valve rest state, some of the valve lifters may be in the process of moving upward or downward.

When the hydraulic pressure for one of the valve lifters is switched while the valve lifter is moving upward or downward, and the valve lifter is therefore placed under a compressive load, the slide pin may not move in a stable manner. It is possible that the engine valve may abruptly close or the valve stem could be wedged in the receiving hole. In either case, the durability of the relevant component parts may be adversely affected, and/or undesired noises may be produced.

SUMMARY OF THE INVENTION

In view of such a problem of the prior art, a primary object of the present invention is to provide a variable valve actuation device that can be switched over between a valve rest state and a valve operating state in a stable manner.

A second object of the present invention is to provide a variable valve actuation device that can be switched over between a valve rest state and a valve operating state without generating noises.

To achieve such objects, the present invention provides a variable valve actuation device (20) for an internal combustion engine (1), comprising: an engine valve (17) including a valve head (31) configured to selectively close an intake port (16I) or an exhaust port (16E) of a combustion chamber (12) of the engine, and a valve stem (32) slidably provided on a cylinder head (4) of the engine, and configured to be actuated by a cam (21*a*) of a camshaft (20); a valve lifter (24) slidably received in a lifter support hole (19*a*) formed in the cylinder head so as to be slidable between an upper position and a lower position, and interposed between the cam and the engine valve; a switching member (53) provided in the valve lifter so as to be movable under hydraulic pressure between a valve operating position where the switching member engages an end surface of the valve stem so as to drive the engine valve under a drive force of the cam and a valve rest position where the switching member is prevented from engaging the end surface of the valve stem so as to keep the engine valve at least partly closed; a valve rest chamber defined in the valve lifter partly by a first pressure receiving surface (53*a*) of the switching member and provided with a valve rest communication passage (58*b*) opening out in a valve rest recess (58*a*) formed at an outer circumferential surface of the valve lifter; and a valve rest passage (60) formed in the cylinder head and having a valve rest supply port (60*a*) opening out at an inner circumferential surface of the lifter support hole; wherein the valve rest recess and the valve rest supply port are positioned such that the valve rest passage and the valve rest chamber communicate with each other when the valve lifter is at the upper position thereof, and continue to communicate with each other until the valve lifter has moved downward in the lifter support hole to a shut-off position located at a prescribed part of an entire down stroke thereof from the upper position thereof, the communication between the valve rest passage and the valve rest chamber being shut off at the shut-off position.

Thus, because the communication between the valve rest passage and the valve rest chamber communicate is shut off at the shut-off position of the valve lifter which may be preferably in a certain upper part of the entire stroke of the valve lifter, the switching member is prevented from moving from the valve rest position to the valve operating position or from the valve operating position to the valve rest position so that the operation of the valve rest mechanism can be performed in a stable manner at all times.

A communication area between the valve rest passage and the valve rest chamber may be maximized when the valve lifter is at the upper position thereof.

Thereby, the transition between the valve rest state and the valve operating state can be effected in a smooth manner when the valve lifter is at the upper position thereof.

The communication area between the valve rest passage and the valve rest chamber progressively may decrease as the valve lifter moves downward from the upper position thereof.

Thereby, the drive force to cause the transition between the valve rest state and the valve operating state can be progressively decreased with the downward displacement of the valve lifter from the upper position thereof so that the transition between the valve rest state and the valve operating state can be effected in a smooth manner at all times.

Preferably, the valve lifter internally defines a switching pin receiving chamber (52) extending diametrically therein, and the switching member comprises a switching pin (53) slidably received in the switching pin receiving chamber, the valve rest chamber being defined by a part of the switching pin receiving chamber which is faced by a first end surface of the switching pin defining the first pressure receiving surface.

Thereby, the valve rest chamber can be formed in a compact manner without requiring any complex manufacturing process.

Preferably, the valve lifter comprises an outer peripheral wall (51) defining a cylindrical outer profile and a switching pin receiving portion (54) extending diametrically between opposing parts of the outer peripheral wall, the switching pin receiving chamber extending in the switching pin receiving portion along an axial direction thereof.

Thereby, the valve lifter can be made of a light-weight, but mechanical stable member.

Preferably, an end part of the switching pin receiving portion is provided with a circumferential extension (54*a*), and the valve rest communication passage extends circumferentially in the circumferential extension from an end of the valve rest chamber to the valve rest recess, the valve rest recess being circumferentially offset from an axial center line of the valve rest chamber and corresponding to the valve rest supply port.

Thereby, the size and the position of the valve rest recess can be selected freely without regard to the configuration of the valve rest chamber without increasing the size of the valve lifter or complicating the internal structure thereof.

An axial line of the switching pin receiving chamber may be at an angle to an axial line of the camshaft in plan view, and the valve rest supply port aligns with a diametric line of the cam lifter extending in parallel with the axial line of the camshaft.

Thereby, the valve rest passage along with the valve rest supply port can be formed laterally with respect to the axial direction of the crankshaft of the engine so that the drilling or otherwise forming the valve rest passage can be facilitated.

The outer peripheral wall of the valve lifter may be provided with an extension wall (51*a*) extending upward from an upper edge of a part of the outer peripheral wall corresponding to the valve rest supply port of the cylinder head with respect to the circumferential direction.

Thereby, the valve rest supply port can be closed by the extension wall when the valve lifter is at the lower position without increasing the overall size of the valve lifter.

According to a preferred embodiment of the present invention, the variable valve actuation device further comprises a valve operating chamber (57) defined in the valve lifter by a part of the switching pin receiving chamber which is faced by a second end surface of the switching pin defining a second pressure receiving surface (52*b*) and provided with a valve operating communication passage (57*b*) communicating with a valve operating recess (57*a*) opening out at an outer circumferential surface of the valve lifter; and a valve operating passage (59) formed in the cylinder head and having a valve operating supply port (59*a*) opening out at an inner circumferential surface of the lifter support hole; wherein the valve operating recess and the valve operating supply port are positioned such that the valve operating passage and the valve operating chamber communicate with each other substantially over an entire vertical stroke of the valve lifter.

Thereby, the valve operating state of the valve actuation device can be accomplished in a prompt manner so that the responsiveness of the valve actuation device can be enhanced.

Preferably, the valve operating communication passage and the valve operating supply port are positioned such that a communication area between the valve operating passage and the valve operating chamber communicate is maximized substantially when the valve lifter is at the shut-off position.

Thereby, the valve operating state of the valve actuation device can be accomplished in a prompt manner so that the responsiveness of the valve actuation device can be particularly enhanced.

Preferably, the switching pin receiving chamber is provided with an open end and a closed end remote from the open end, the valve operating chamber being defined by the closed end of the switching pin receiving chamber and the second end of the switching pin, and the valve rest chamber being defined by the open end of the switching pin receiving chamber and the first end of the switching pin, and a compression coil spring (61) is interposed between the closed end of the switching pin receiving chamber and the second end of the switching pin.

Thereby, the switching pin receiving chamber can be formed as a blind hole typically by drilling the valve lifter from one side thereof in a highly simple manner. The closed end of the switching pin receiving chamber can be conveniently used as a retainer for the compression coil spring that urges the switching pin toward the valve rest chamber. If the hydraulic pressure is lost, the compression coil spring forces the switching pin to the valve operating position so that the engine can be operated without any significant problem.

The switching pin may be provided with an abutting surface configured to abut the end surface of the valve stem of the engine valve, and a hole provided adjacent to the abutting surface and configured to receive the stem end of the engine valve.

Thereby, the switching pin may consist of a highly simple member.

Preferably, a certain gap is created between the abutting surface and the end surface of the valve stem when the switching pin is at the valve operating position and the valve lifter is at the upper position thereof.

Thereby, when the valve lifter is at the upper position thereof, the switching pin is allowed to move between the valve rest position and the valve operating position without encountering any resistance from the switching pin so that the transition between the valve rest state and the valve operating state can be accomplished in a particularly smooth manner.

Preferably, the abutting surface is provided with a flat bottomed recess configured to receive the stem end when the switching pin is at the valve operating position and the valve lifter is at the upper position, the depth of the recess being smaller than a vertical dimension of the gap.

Thereby, when the valve lifter is pushed down from the upper position thereof, and is therefore receiving a downward pressure from the cam typically via a rocker arm, the recess retains the stem end with a certain force so that the transition between the valve rest state and the valve operating state can be performed in a stable manner.

The stem end of the engine valve may be provided with a chamfered or rounded portion having a vertical dimension greater than the depth of the recess.

Thereby, the stem end is prevented from being excessively retained by the recess, and this contributes to a stable operation of the valve rest mechanism.

Preferably, a rocker arm is interposed between the valve lifter and the corresponding cam of the camshaft, and the rocker arm is provide with a roller configured to be engaged by the cam, an axial line of the roller being slightly angularly offset relative to an axial line of the camshaft.

Thereby, a thrust force is produced so as to act upon the cam shaft in the axial direction owing to the rolling engagement between the roller and the cam, and this removes any axial play that may be present in the bearings of the camshafts.

DETAILED DESCRIPTION OF THE PREFERRED EMBODIMENT(S)

A preferred embodiment of the present invention is described in the following with reference to the appended drawings.

Figure 1:
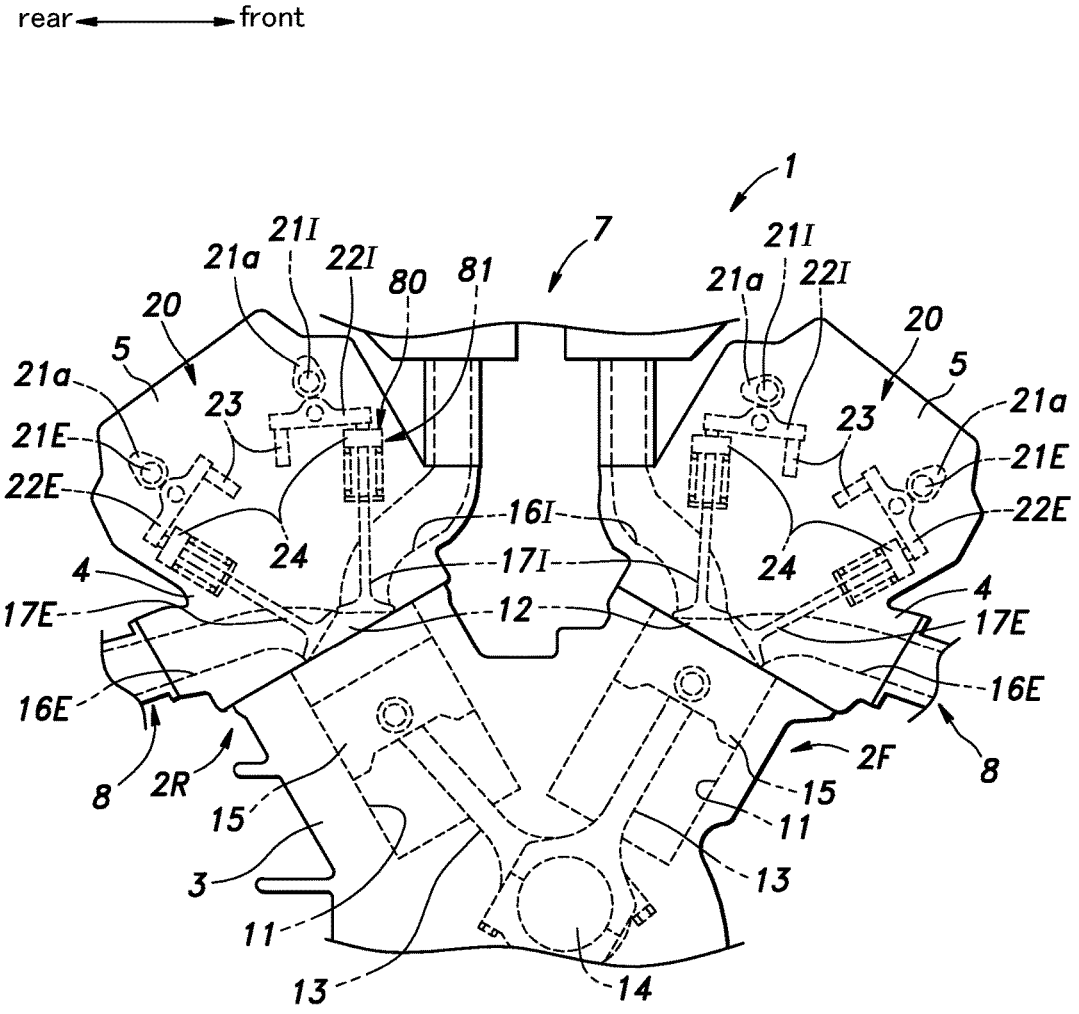
FIG. 1 is a front view of an internal combustion engine to which a variable valve actuation device according to an embodiment of the present invention is applied.

FIG. 1 is a front view of an engine 1 to which a variable valve actuation device according to the present invention is applied. As shown in FIG. 1, the engine 1 is a DOHC six-cylinder, gasoline V engine, and is disposed horizontally in an engine room so that the right side of FIG. 1 is on the front side the vehicle. Hereinafter, the front, rear, left and right directions are defined with reference to the traveling direction of the vehicle on which the engine 1 is mounted. For the sake of convenience of explanation, the upper and lower directions may be defined with respect to the cylinder axial line, and the forward and backward directions may be based on the traveling direction of the vehicle. Depending on the situation, the upper and lower directions may be also based on the axial line of an engine valve.

The engine 1 includes a V-shaped cylinder block 3 having a front cylinder bank 2F and a rear cylinder bank 2R one behind the other, a pair of cylinder heads 4 attached to the upper ends of the respective cylinder banks 2F and 2R, and a pair of head covers 5 attached to the upper ends of the respective cylinder heads 4. The engine 1 further includes an intake device 7 disposed between the front and rear cylinder banks 2, and an exhaust system 8 disposed on the sides of the front and rear cylinder banks 2 facing away from the intake device 7.

Three cylinder bores 11 are formed in each cylinder bank 2F, 2R, and a combustion chamber recess 12 is formed in a part of each cylinder head 4 facing the corresponding cylinder bore 11. Each cylinder bore 11 and the corresponding combustion chamber recess 12 jointly defines an engine cylinder. Each cylinder bore 11 receives a piston 15 connected to a crankshaft 14 via a connecting rod 13 in a slidable manner. The crankshaft 14 is provided with a rotational center line extending in the lateral direction of the vehicle.

Each combustion chamber recess 12 communicates with an end of a corresponding intake port 16I opening to the inner side of the cylinder bank of the cylinder head 4 and a corresponding exhaust port 16E opening to the outer side of the cylinder bank. Two intake ports 16I and two exhaust ports 16E are provided for each combustion chamber recess 12 in the illustrated embodiment. A part of each intake port 16I adjoining the combustion chamber recess 12 can be selectively closed and opened by a corresponding intake valve 171 slidably provided in the cylinder head 4, and a part of each exhaust port 16E adjoining the combustion chamber recess 12 can be selectively closed and opened by a corresponding exhaust valve 17E slidably provided in the cylinder head 4. The engine 1 is provided with a pair of valve actuation devices 20 for driving the intake and exhaust valves 17 of the respective cylinder banks 2.

Each valve actuation device 20 is provided with an intake camshaft 211 and an exhaust camshaft 21E each fitted with cams 21*a*, rocker arms 22 (intake rocker arms 221 and exhaust rocker arms 22E) interposed between the cams 21*a* and the corresponding engine valves 17, lash adjusters 23 for pivotally supporting the respective rocker arms 22, and valve lifters 24 interposed between the rocker arms 22 and the corresponding engine valves 17. The camshafts 21 rotate in synchronism with the crankshaft 14 so that each engine valve 17 is driven by the corresponding cam 21 via the corresponding rocker arm 22 and valve lifter 24 as the crankshaft 14 rotates.

Figure 2:
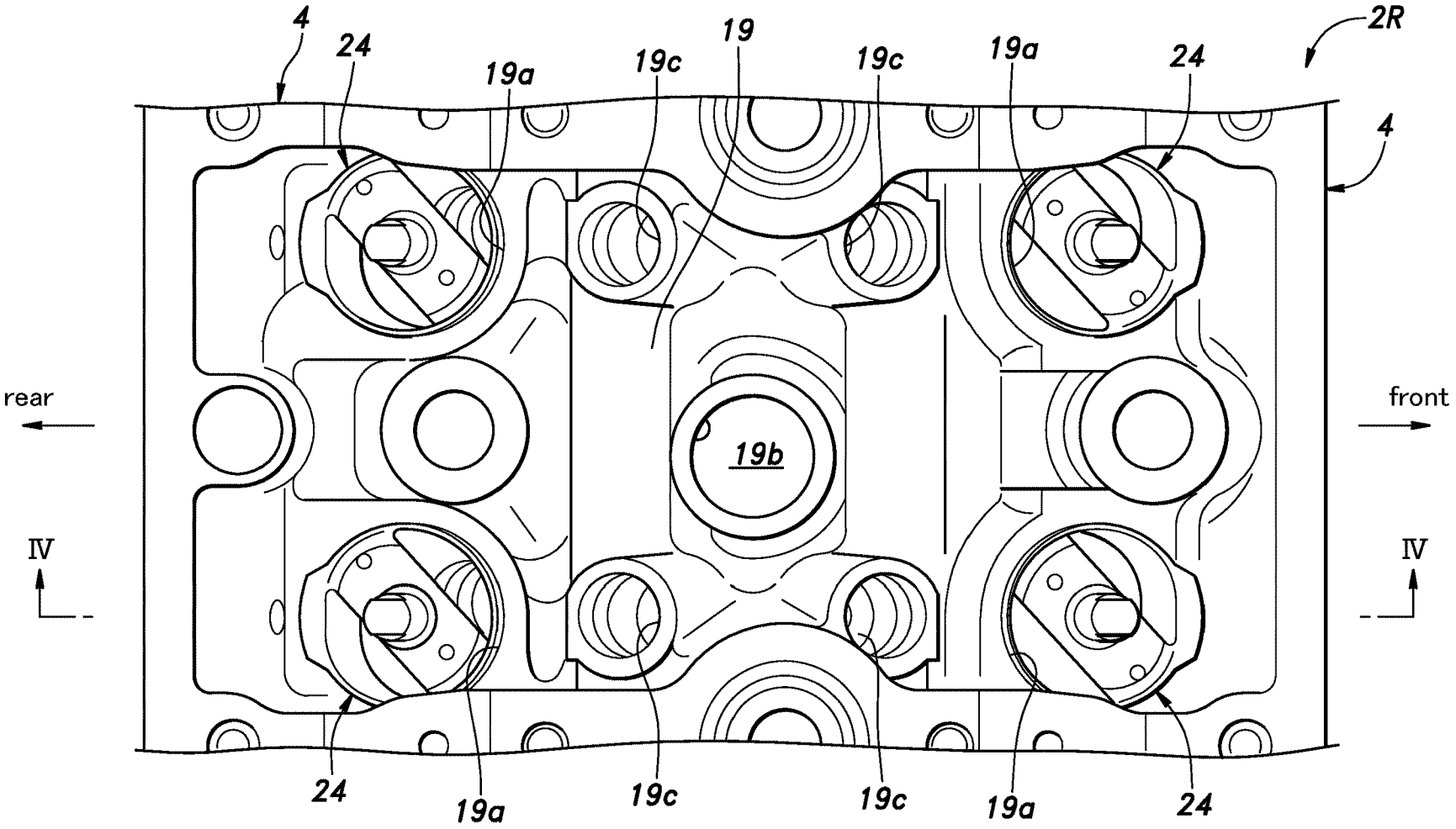
FIG. 2 is an enlarged plan view of a cylinder head of a rear cylinder bank shown in FIG. 1.
Figure 3:
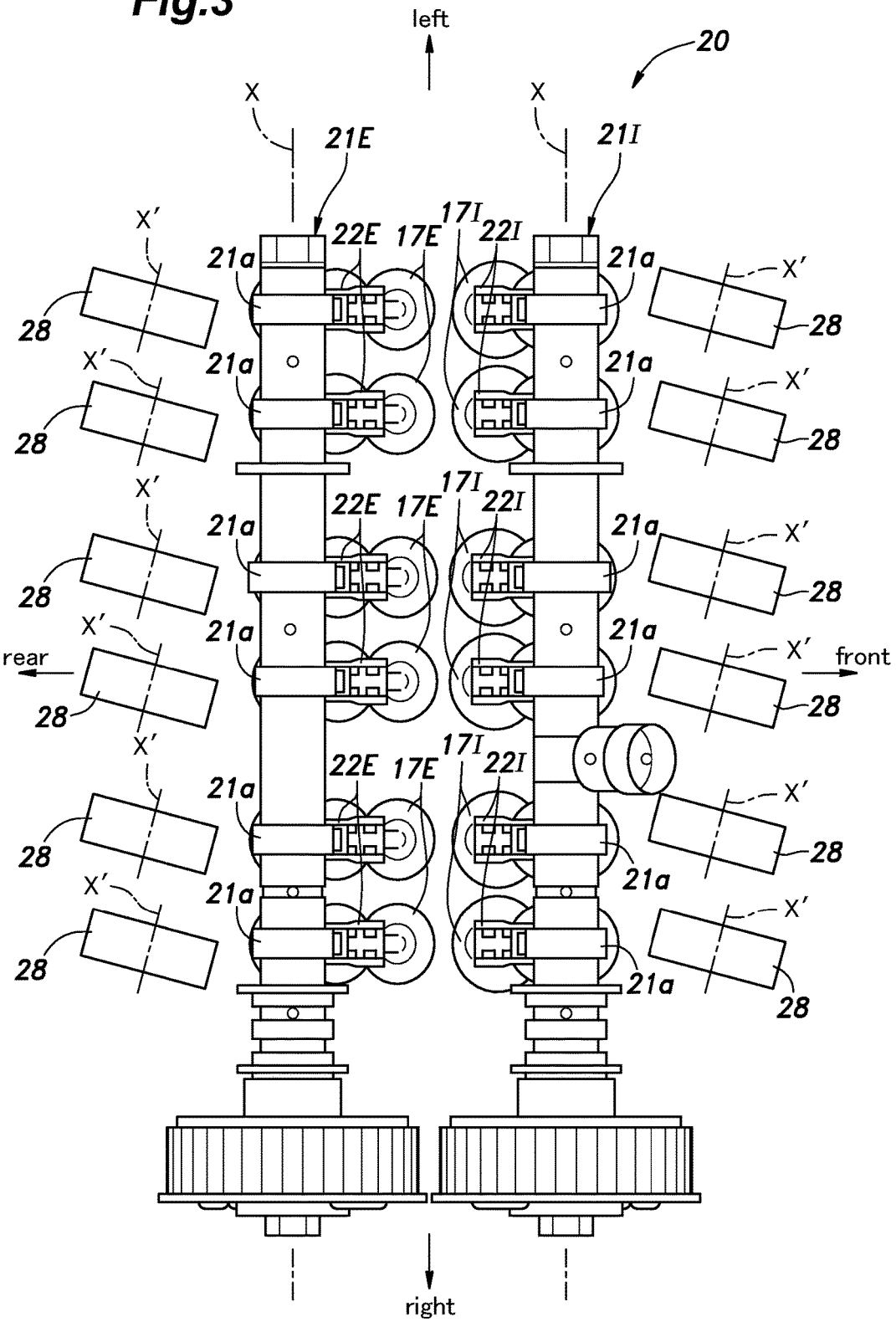
FIG. 3 is a schematic plan view of the valve actuation device of the rear cylinder bank.
Figure 4:
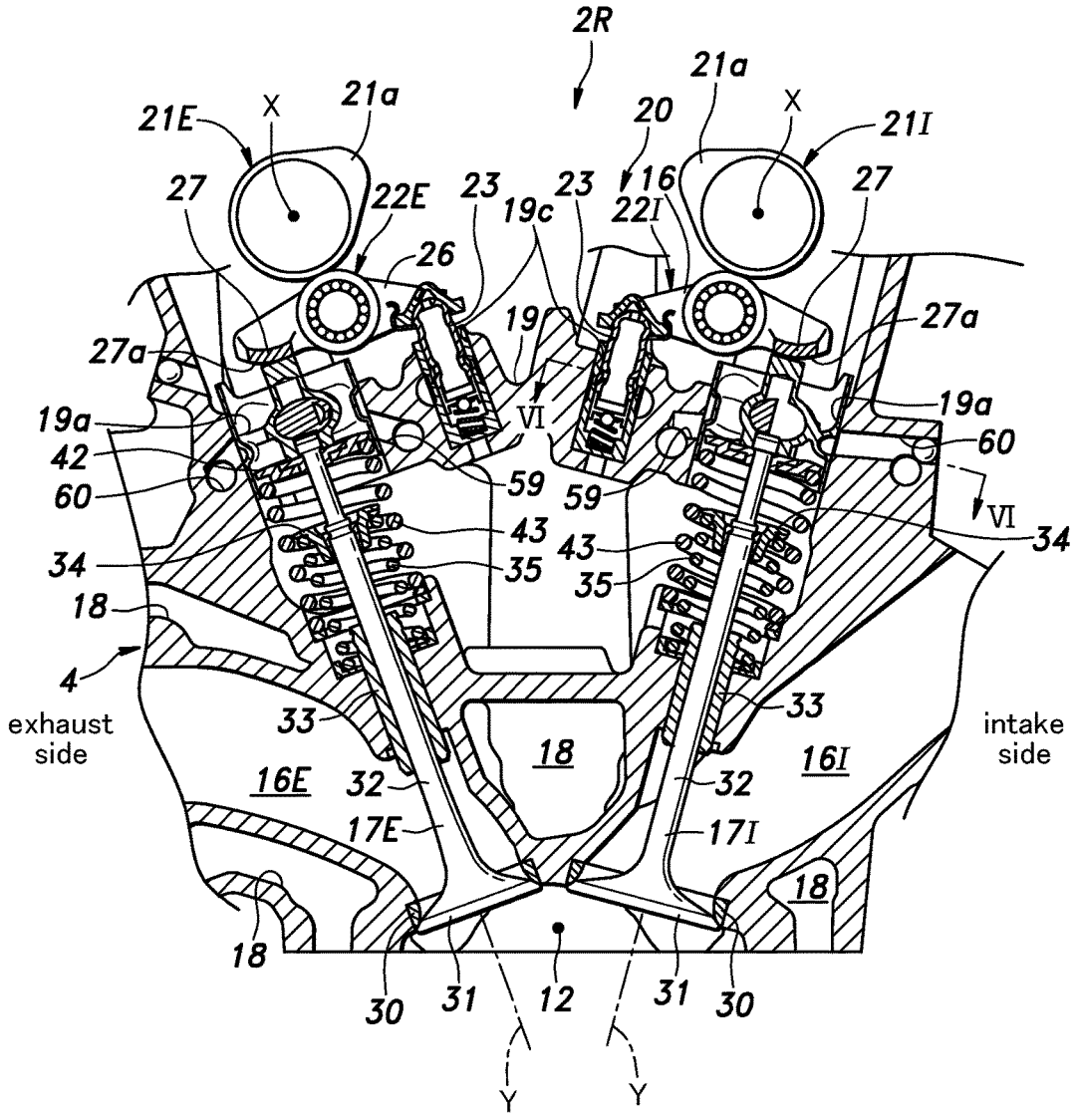
FIG. 4 is a sectional view of the cylinder head of the rear cylinder bank taken along line IV-IV of FIG. 2.
Figure 5:
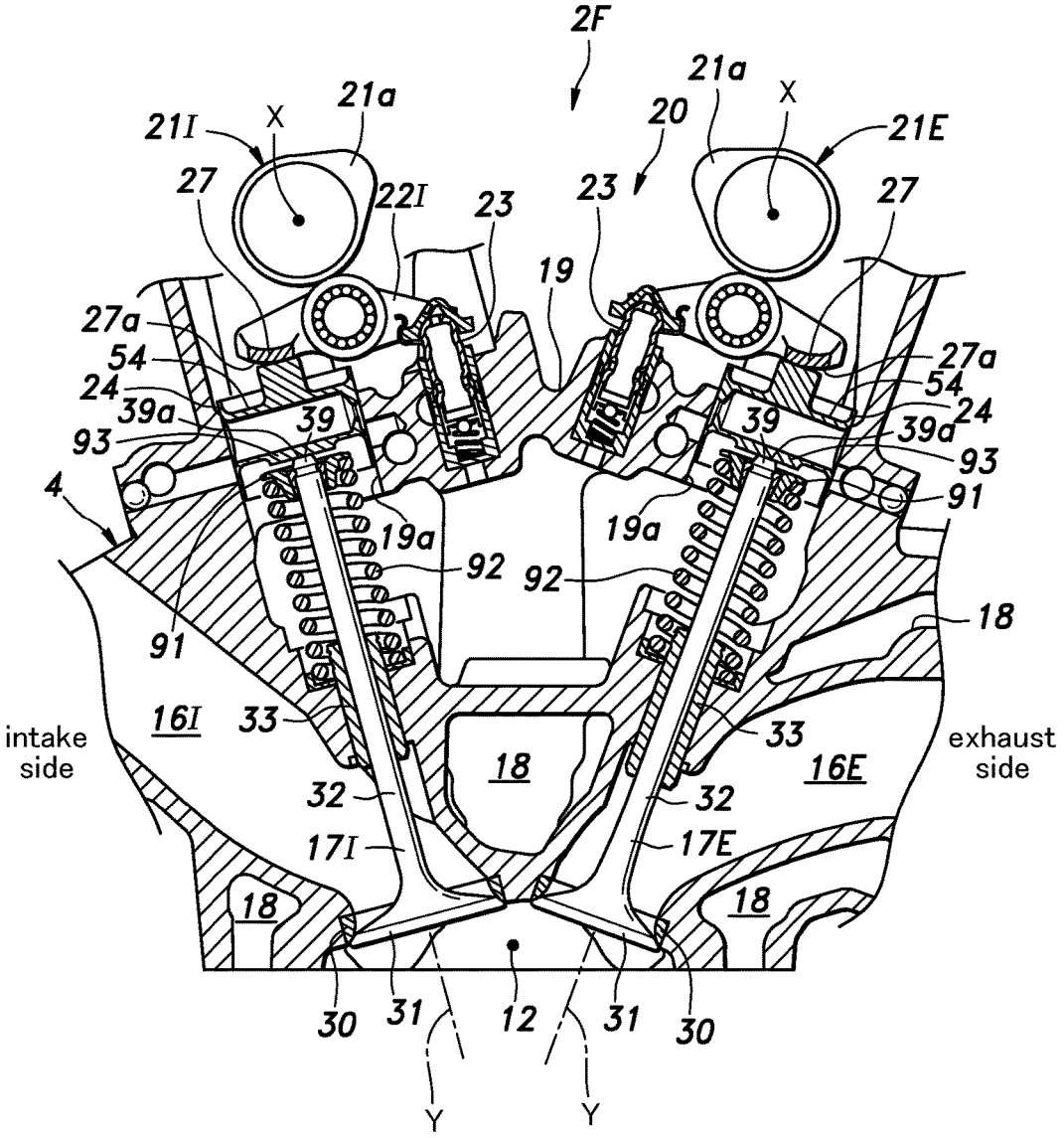
FIG. 5 is a sectional view of the cylinder head of the front cylinder bank.

FIG. 2 is an enlarged plan view of the cylinder head 4 of the rear cylinder bank 2R, and FIG. 3 is a schematic plan view of the valve actuation device 20 of the rear cylinder bank 2R. FIG. 4 is a sectional view showing the cylinder head 4 of the rear cylinder bank 2R taken along line IV-IV of FIG. 2. FIG. 5 is a sectional view similar to FIG. 4 showing the cylinder head 4 of the front cylinder bank 2F. The valve actuation device 20 of the front cylinder bank 2F differs from the valve actuation device 20 of the rear cylinder bank 2R in not being provided with a valve rest mechanism which will be described hereinafter, but is otherwise similar to the valve actuation device 20 of the rear cylinder bank 2R. The valve actuation device 20 of the rear cylinder bank 2R is described first with reference to FIG. 4, and the valve actuation device 20 of the front cylinder bank 2F is then described with reference to FIG. 5 mostly in regards to the differences from the valve actuation device 20 of the rear cylinder bank 2R.

As shown in FIG. 4, the cylinder head 4 internally defines a water jacket 18 that circulates cooling water through various parts of the cylinder head 4 located above combustion chamber recess 12, above and below the exhaust port 16E, and below the intake port 16I. The cylinder head 4 is provided with a support wall 19 defining the upper end of the part of the water jacket 18 located above the combustion chamber for supporting the lash adjusters 23 and slidably supporting the valve lifters 24. The support wall 19 of the cylinder head 4 is formed with lifter support holes 19*a* in a coaxially relationship to the corresponding engine valves 17 for supporting the respective valve lifters 24 so as to be slidable along the sliding direction of the engine valves 17.

As shown in FIG. 2, each cylinder is provided with four of the lifter support holes 19*a*, two on the front side or on the intake side and two on the rear side on the exhaust side. The two lifter support holes 19*a* on the intake side are formed so as to be parallel to each other and to be inclined forward, and the two lifter support holes 19*a* on the exhaust side are formed so as to be parallel to each other and inclined rearward. A fuel injector support hole 19*b* for mounting a fuel injector is formed in a part of the support wall 19 corresponding to the center of the corresponding cylinder. The support wall 19 is further provided with four lash adjuster holes 19*c* for each cylinder inwardly adjoining the lifter support holes 19*a*.

As shown in FIG. 4, a lash adjuster 23 is received in each lash adjuster hole 19*c* so as to pivotally support a base end of a rocker arm 22. The rocker arm 22 includes a pair of side walls 26, and the free end of the rocker arm 22 is provided with a connecting piece 27 extending between the side walls 26 and engaging the upper end of the corresponding valve lifter 24. A middle part of the rocker arm 22 is provided with a shaft extending between the two side walls 26 and rotatably supporting a roller 28 that is engaged by the corresponding cam 21*a* of the exhaust camshaft 21E or the intake camshaft 211.

As shown in FIG. 3, the camshafts 21 on the intake side and the exhaust side extend in the lateral direction of the vehicle. The central axial lines of the camshafts 21 are denoted with letter X. The axial lines Y of the rollers 28 of the intake rocker arms 221 are slightly inclined relative to the axial line of the camshaft 21. Therefore, a thrust force acts upon each camshaft 21 owing to the rolling engagement between the rollers 28 and the cams, and this removes any axial plays that may be present in the bearings of the camshafts 21.

As shown in FIG. 4, each engine valve 17 is provided with a valve head 31 configured to be selectively seated on a corresponding valve seat 30 provided on the upper wall surface of the combustion chamber recess 12 so as to open and close an intake port or an exhaust port of the combustion chamber recess 12, and a valve stem 32 slidably supported by a cylindrical valve guide 33 attached to the cylinder head 4 so as to be driven by the cam 21*a* of the camshaft 21. A valve lifter 24 which is slidably received in a corresponding lifter support hole 19*a* is interposed between the stem end of each engine valve 17 and the free end of the corresponding rocker arm 22. In the illustrated embodiment, the valve lifters 24 of the rear cylinder bank 2R are each incorporated with a valve rest mechanism which will be described hereinafter whereas the valve lifters 24 of the front cylinder bank 2F are not provided with a valve rest mechanism.

The valve rest mechanism is actuated by hydraulic pressure, and is configured to selectively produce a valve operating state in which the engine valves 17 are opened and closed according to the rotation of the camshaft 21, and a valve rest state in which the engine valves 17 are kept closed without regard to the rotation of the camshaft 21. The valve rest mechanism is incorporated in each of the four valve lifters 24 provided for each cylinder so that all of the valve rest mechanisms are simultaneously switched between the valve operating state and the valve rest state. In the valve rest state, the piston simply compresses and decompresses the air in the cylinder, and no drive force is produced from the cylinder.

An all cylinder operation (where all of the cylinders are in the valve operating state) is selected when the engine load is high such as when starting or acceleration of the vehicle. A cylinder rest operation (where at least some of the cylinders are in the valve rest state) is selected when the load is light such as when cruising at high speed and idling. A control unit of the vehicle (not shown in the drawings) selects the all cylinder operation and the cylinder rest operation according to the operating condition of the vehicle.

Referring to FIG. 5 once again, the difference of the valve actuation device 20 of the front cylinder bank 2F from that of the rear cylinder bank 2R is described in the following. In this case also, as the intake side and the exhaust side are symmetric to each other, the various components are simply denoted with numerals without the suffixes for indicating if the particular component part belongs to the intake side or the exhaust side of the engine.

As shown in FIG. 5, in the valve actuation device 20 for the front cylinder bank 2F, the valve lifter 24 interposed between the engine valve 17 and the rocker arm 22 is not internally incorporated with a valve rest mechanism. However, the main body of the valve lifter 24 for the front cylinder bank 2F may be made from a common die cast or forged member as that for the rear cylinder bank 2R, and the main body may be made into two kinds of main body by machining the common die cast or forged member differently. The engine valve 17 consists of a regular poppet valve including a valve head 31 and a valve stem 32. The valve stem 32 has a uniform cross section substantially over the entire length thereof. A third retainer 81 is attached to a part of the stem end 39 of the valve stem 32 via a third valve cotter 80, and supports an end of a third valve spring 82 having a substantially same outer diameter as the first valve spring 35 and a slightly greater wire diameter than the first valve spring 35. The other end of the third valve spring 82 is supported by a spring seat provided in the support wall of the cylinder head 4. The third valve spring 82 consists of a compression coil spring, and normally urges the engine valve 17 in the closing direction. The third retainer 81 and the third valve cotter 80 are similar to the first retainer 36 and the first cotter 37, respectively.

The valve lifter 24 is not incorporated with the valve rest mechanism, but is otherwise similar to those used in the rear cylinder bank 2R. In the illustrated embodiment, the valve lifter 24 is provided with a pin receiving hole, but is not provided with a switching pin 53. The lower wall of the main body of the valve lifter 24 is provided with a circular projection 83, but is not provided with a through hole 65. Therefore, the end surface 39*a* of the stem end 39 of the engine valve 17 always centrally abuts the circular projection 83 of the valve lifter 24 so that the engine valve 17 is actuated in the opening direction as the valve lifter 24 is driven downward by the cam 21*a* via the rocker arm 22.

Figure 6:
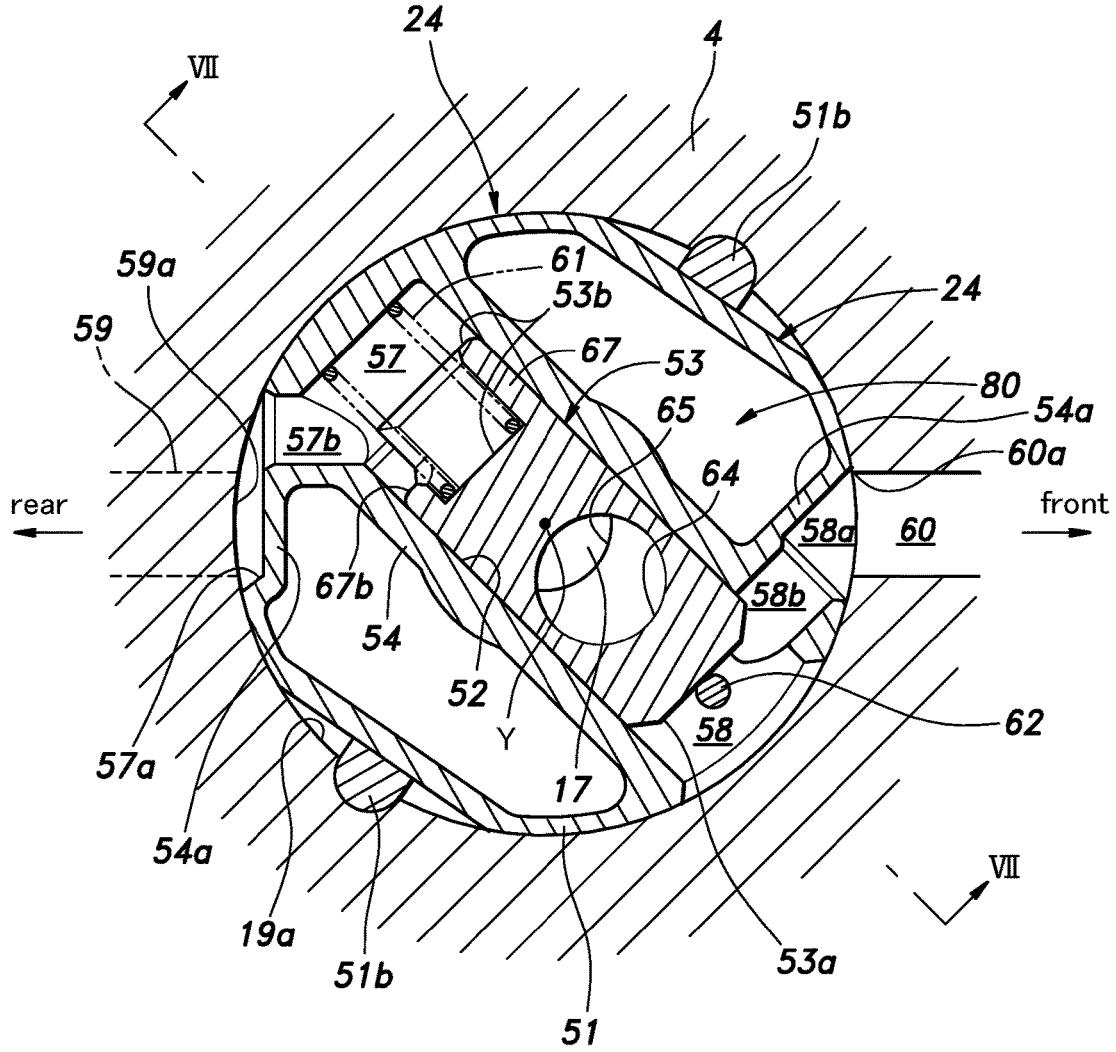
FIG. 6 is a sectional view taken along line VI-VI of FIG. 4.
Figure 7:
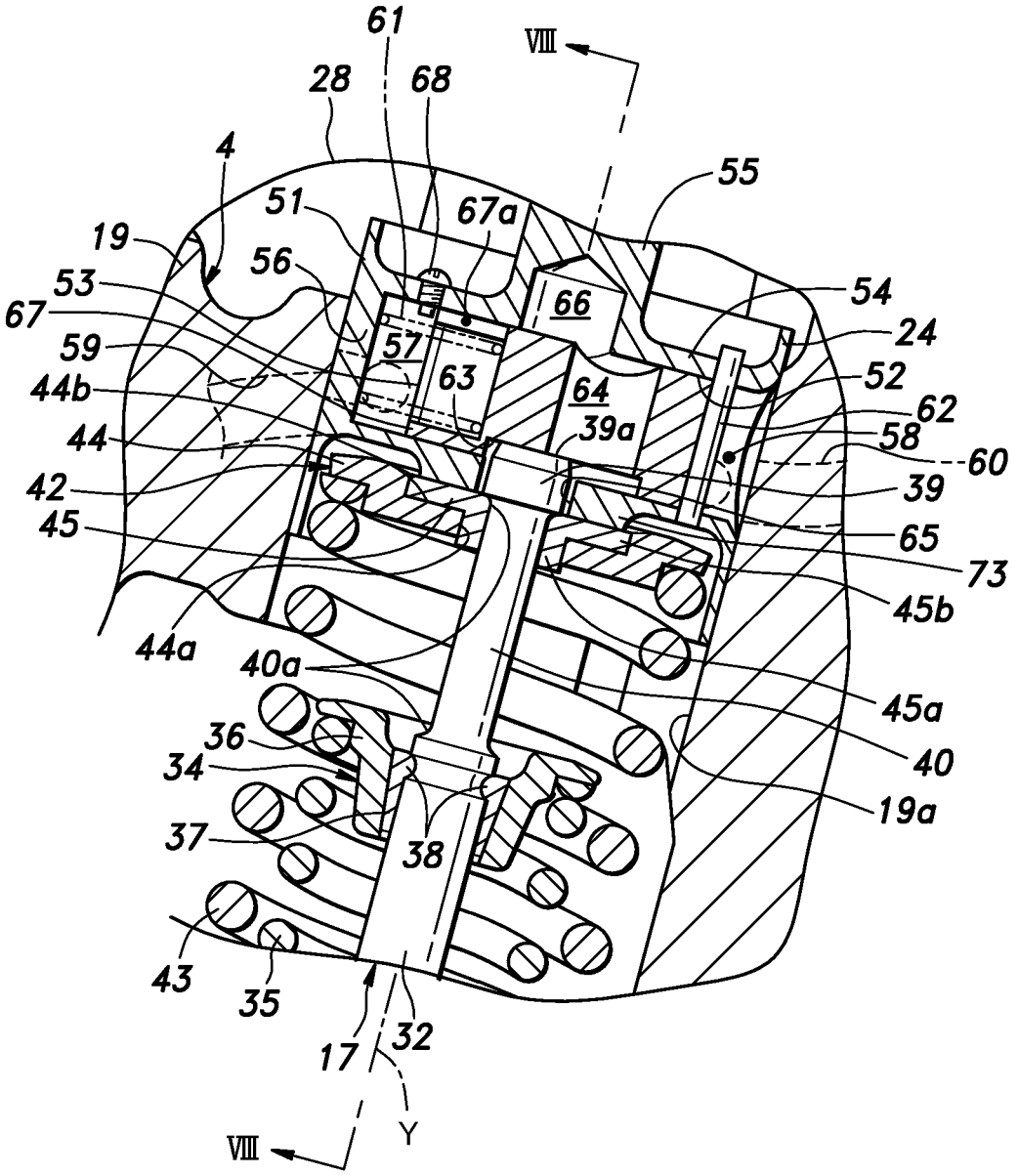
FIG. 7 is a sectional view taken along line VII-VII of FIG. 6.

FIG. 6 is a sectional view taken along line VI-VI of FIG. 4, and FIG. 7 is a sectional view taken along line VII-VII of FIG. 4. In FIGS. 6 and 7, the valve rest mechanism is in the valve operating state, and the valve lifter 24 is at the base position where the engine valve 17 is closed. As the valve actuation device 20 is similarly provided for the intake side and the exhaust side, no distinction is made between the exhaust side and the intake side. When distinction between the intake side and the exhaust side is required to be made, the numerals denoting the relevant component parts are followed by a suffix "E" and "X" to indicate which side the component parts are located.

As shown in FIGS. 4 and 7, a first valve spring 35 consisting of a compression coil spring having a relatively small diameter surrounds the valve stem 32, and has an upper end engaged by a first spring support portion 34 fixed to an intermediate part of the valve stem 32 and a lower end supported by a valve seat formed in the cylinder head 4 so that the engine valve 17 is urged in the valve closing direction.

The first spring support portion 34 includes a first retainer 36 having a generally inverted truncated cone shape and a tapered central hole surrounding the valve stem 32 and having a larger inner diameter than the outer diameter of the valve stem 32, and a first cotter 37 fitted into an annular gap defined between the central hole of the first retainer 36 and the valve stem 32. The first cotter 37 consists of a pair of semi-cylindrical halves which jointly define an outer profile complementary to the tapered central hole of the first retainer 36, and a cylindrical inner hole snugly receiving the valve stem 32. The cylindrical inner hole of the first cotter 37 is formed with an annular protrusion 38, and the valve stem 32 is formed with an annular groove that closely receives the annular protrusion 38.

The part of the valve stem 32 extending between the first spring support portion 34 and a stem end 39 is formed as a small diameter portion 40 having a smaller diameter than the remaining part of the valve stem 32 in a coaxial relationship. A second spring support portion 42 is slidably fitted on the small diameter portion 40. An annular shoulder surface 40*a* defined between the stem end 39 and the small diameter portion 40 limits the upward movement of the second spring support portion 42 relative to the valve stem 32. The annular shoulder surface 40*a* is rounded. A second valve spring 43 consisting of a compression coil spring having a relatively large diameter surrounds the first valve spring 35, and has an upper end engaged by the second spring support portion 42 and a lower end supported by a valve seat formed in the cylinder head 4 so that the engine valve 17 is urged in the valve closing direction.

The second spring support portion 42 includes an annular second retainer 44 consisting of an annular metallic disk and having a central through hole 44*a* having a larger diameter than the stem end 39, and a second cotter 45 consisting of two halves and interposed between the small diameter portion 40 and the annular second retainer 44. The second cotter 45 is provided with a central tubular portion 45*a* defining a central through hole and a radial flange 45*b* extending radially from and upper part of the tubular portion 45*a*. The central part of the upper surface of the second retainer 44 is formed with a concentric circular recess 44*b* which receives the radial flange 45*b* of the second cotter 45, and the tubular portion 45*a* of the second cotter 45 is received in the central through hole 44*a* of the second retainer 44. Thus, the central through hole of the second cotter 45 is slidably fitted on the small diameter portion 40, and the outer peripheral part of the lower surface of the second retainer 44 engages the upper end of the second valve spring 43.

As shown in FIGS. 6 and 8, a pair of engagement pieces 51*b* project radially from the outer peripheral wall 51. Each engagement piece 51*b* is slidably engaged by an engagement groove 19*d* formed on the inner peripheral surface of the lifter support hole 19*a* and extending in the axial direction so that the valve lifter 24 is prevented from rotating around the axial line Y thereof as the valve lifter 24 slides axially in the lifter support hole 19*a*.

Figure 8B:
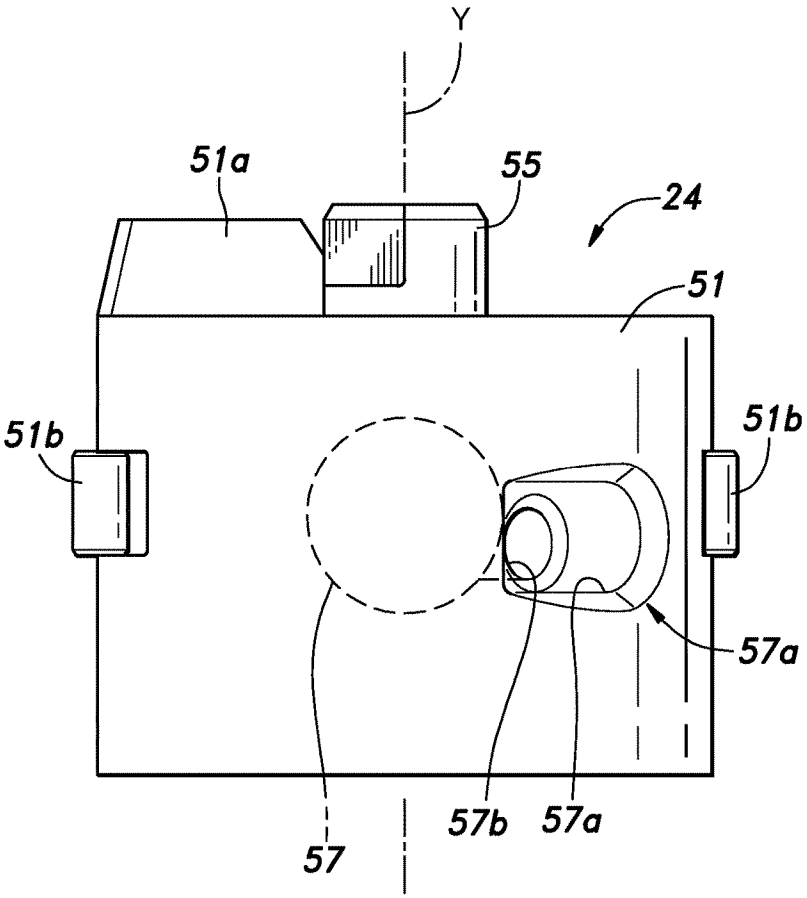
FIG. 8*b* is a front view of the valve lifter as seen in the direction indicated by B in FIG. 8*a;*
Figure 8A:
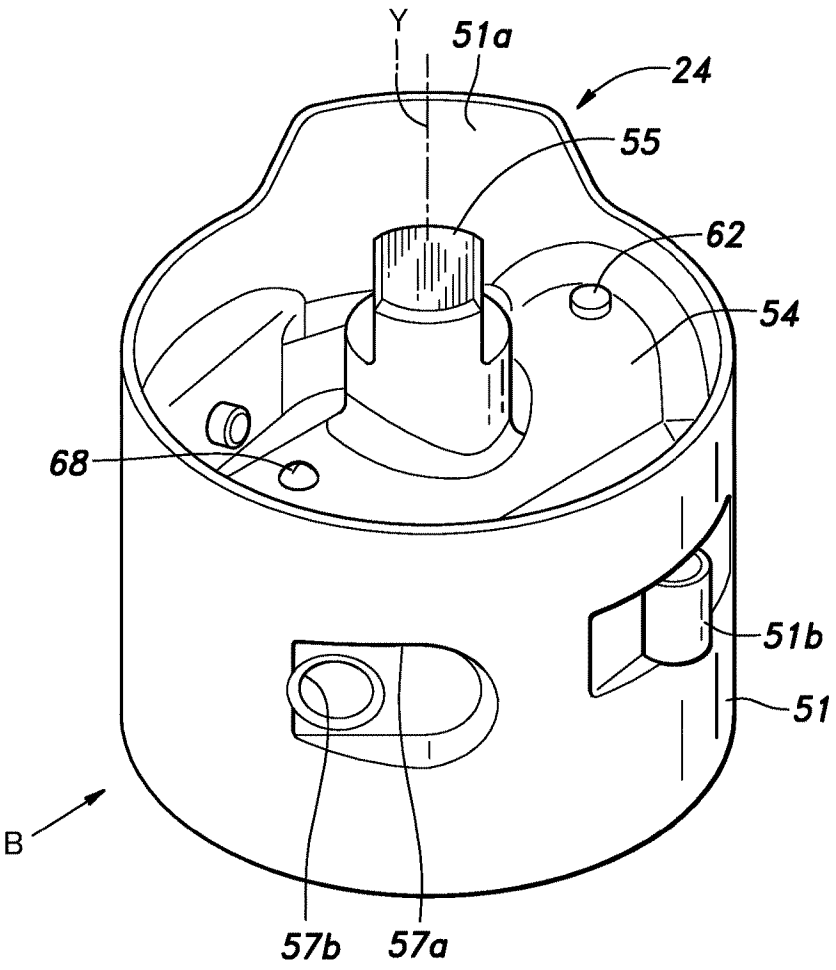
FIG. 8*a* is a perspective view of a valve lifter on the intake side as viewed from a rear side.
Figure 9B:
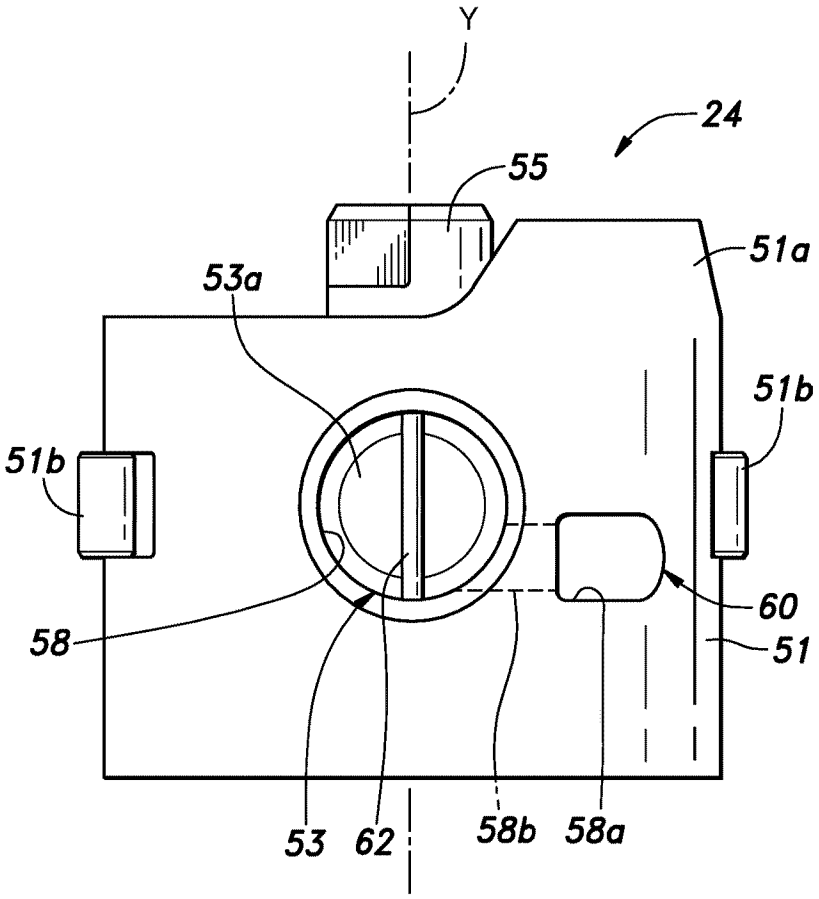
FIG. 9*b* is a front view of the valve lifter as seen in the direction indicated by B in FIG. 9*a*
Figure 9A:
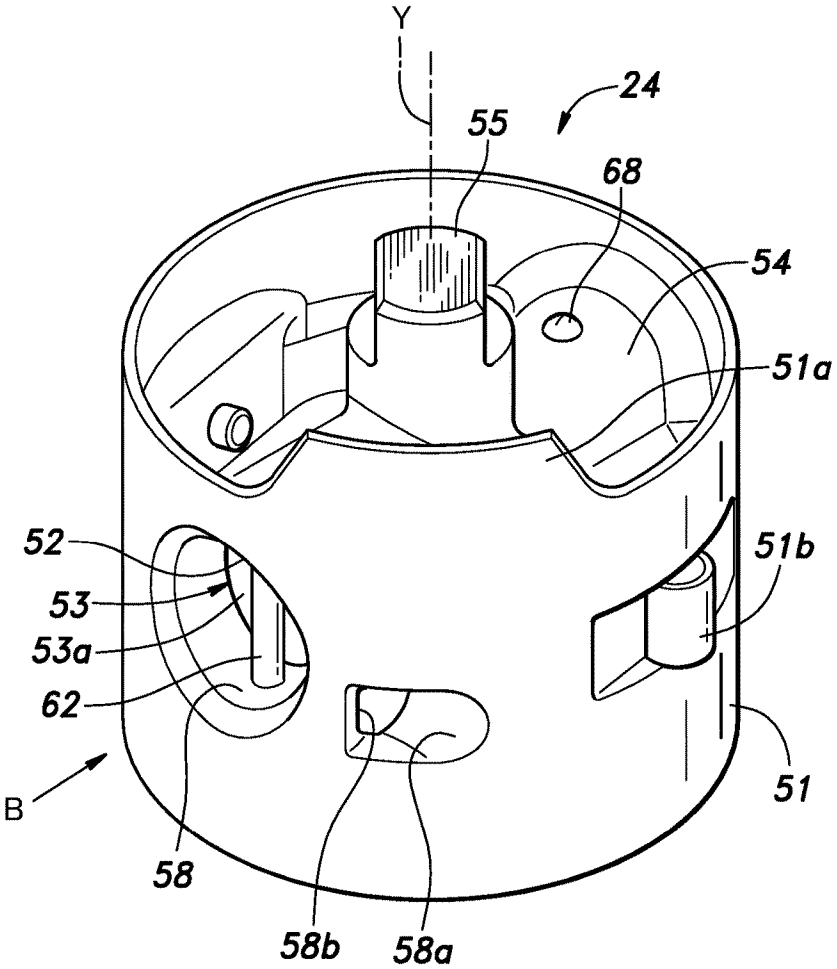
FIG. 9*a* is a perspective view of the valve lifter on the intake side as viewed from a font side.

FIG. 8*a* is a perspective view of the valve lifter 24 on the intake side as viewed from the rear, and FIG. 8*b* is a view as seen in the direction of arrow B in FIG. 8*a*. FIG. 9*a* is a perspective view of the valve lifter 24 as viewed from the front, and FIG. 9*b* is a view as seen in the direction of arrow B in FIG. 9*a*. As shown in FIGS. 6 to 9, the valve lifter 24 is provided with a cylindrical outer peripheral wall 51 which is in sliding contact with the inner peripheral surface of the lifter support hole 19*a* and a cylindrical pin receiving portion 54 extending diametrically between the opposing parts of the outer peripheral wall 51. A front part of the outer peripheral wall 51 is provided with an extension wall 51*a* extending upward therefrom. A blind hole is passed axially into the pin receiving portion 54 from one end thereof so as to define a pin receiving chamber 52. A projection 55 projects upward from the upper side of the middle point of the pin receiving portion 54. The upper end of the projection 55 is formed as a planar surface, and is slightly higher than the upper edge of the extension wall 51*a*. The valve lifter 24 may consist of a solid metallic member, but, in the illustrated embodiment, the valve lifter 24 is formed as a relatively hollowed out member so as to minimize the weight of the valve lifter 24.

As shown in FIGS. 6 and 7, the pin receiving chamber 52 is provided with an open end and a closed end. A switching pin 53 is received in the pin receiving chamber 52 so that a valve operating chamber 57 is defined on the closed end side of the pin receiving chamber 52, and a valve rest chamber 58 is defined on the open end side of the pin receiving chamber 52. The switching pin 53 is provided with a first pressure receiving surface 53*a* facing the valve rest chamber 58, and a second pressure receiving surface 53*b* facing the valve operating chamber 57. The valve operating chamber 57 receives a compression coil spring 61 that urges the switching pin 53 toward the valve rest chamber 58, and a stopper pin 62 extends across the valve rest chamber 58 so as to limit the movement of the switching pin 53 toward the valve rest chamber 58.

As shown in FIGS. 4 and 7, the cylinder head 4 internally defines a valve operating passage 59 opening out to the lifter support hole 19*a* via a valve operating supply port 59*a* from the inner side (left side in FIG. 7), and a valve rest passage 60 opening out to the lifter support hole 19*a* from the outer side (right side in FIG. 7). As shown in FIG. 4, the valve operating passage 59 and the valve rest passage 60 on the intake side are formed as linear passages aligning with each other so that these passages can be formed by a single drilling process whereas the valve operating passage 59 and the valve rest passage 60 on the exhaust side are formed as linear passages not aligning with each other which are formed by two individual drilling processes. The control unit of the engine supplies hydraulic pressure to a selected one of the valve operating passage 59 and the valve rest passage 60 at any particular moment.

FIGS. 6 and 7 show the state in which the rocker arm 22 is engaged by a base part of the cam 21*a* so that the valve lifter 24 is at an upper limit position. As shown in FIG. 6, the axial line of the pin receiving chamber 52 is angularly offset relative to the common axial line of the valve operating passage 59 and the valve rest passage 60. An end part of the cylindrical pin receiving portion 54 on the side of the valve operating chamber 57 is provided with a circumferential extension 54*a* extending toward the valve operating supply port 59*a*, and a valve operating recess 57*a* formed on a part of the outer peripheral wall 51 aligning with the valve operating supply port 59*a* in plan view communicates with the valve operating chamber 57 via a valve operating communication passage 57*b* formed in the circumferential extension 54*a*. The valve operating communication passage 57*b* has a smaller cross sectional area than the valve operating chamber 57, and the open area of the valve operating recess 57*a* is greater than the cross sectional area of the valve operating communication passage 57*b*. As shown in FIG. 8*b*, the upper edge of the valve operating recess 57*a* is lower than the upper edge of the valve operating chamber 57.

As shown in FIG. 6, an end part of the cylindrical pin receiving portion 54 on the side of the valve rest chamber 58 is provided with a circumferential extension 54*a* extending toward the valve rest supply port 60*a*, and a valve rest recess 58*a* formed on a part of the outer peripheral wall 51 aligning with the valve rest supply port 60*a* in plan view communicates with the valve rest chamber 58 via a valve rest communication passage 58*b* formed in the circumferential extension 54*a*. The valve rest communication passage 58*b* has a smaller cross sectional area than the valve rest chamber 58, and the open area of the valve rest recess 58*a* is greater than the cross sectional area of the valve rest communication passage 58*b*. As shown in FIG. 9*b*, the upper edge of the valve rest recess 58*a* is lower than the upper edge of the valve rest chamber 58.

The valve operating communication passage 57*b* connecting the valve operating chamber 57 with the valve operating recess 57*a* and the valve rest communication passage 58*b* connecting the valve rest chamber 58 with the valve rest recess 58*a* are optional. The valve operating communication passage 57*b* may be directly connected to the valve operating chamber 57, and the valve rest communication passage 58*b* may be directly connected to the valve rest chamber 58 without departing from the spirit of the present invention. By thus circumferentially offsetting the end parts of the valve operating chamber 57 and the valve rest chamber 58 from the valve operating recess 57*a* and the valve rest recess 58*a*, respectively, the shapes and the positions of the valve operating recess 57*a* and the valve rest recess 58*a* can be freely selected.

As shown in FIGS. 2 and 6, the valve operating supply port 59*a* circumferentially aligns with the valve operating recess 57*a* as viewed in the axial direction, and the valve rest supply port 60*a* also circumferentially aligns with the valve rest recess 58*a* as viewed in the axial direction, and this relationship is maintained at all times owing to the engagement between the engagement pieces 51*b* and the respective engagement grooves.

Thus, the switching pin 53 moves to the side of the valve rest chamber 58 until the corresponding side of the switching pin 53 abuts the stopper pin 62 when a hydraulic pressure is supplied to the valve operating chamber 57 via the valve operating passage 59, and moves to the side of the valve operating chamber 57 until the corresponding side of the switching pin 53 abuts the closed bottom end of the valve operating chamber 57 when a hydraulic pressure is supplied to the valve rest chamber 58 via the valve rest passage 60. The spring force of the compression coil spring 61 assists the movement of the switching pin 53 toward the valve rest chamber 58, and resists the movement of the switching pin 53 toward the valve operating chamber 57.

As shown in FIG. 7, a flat abutting surface 63 orthogonal to the central axial line of the outer peripheral wall 51 is formed in an axially intermediate part of the lower surface of the switching pin 53, and the lower wall of the pin receiving portion 54 is formed with a through hole 64 dimensioned so as to receive the stem end 39 in a coaxial relationship. The projection 55 of the valve lifter 24 is internally formed with an extension hole 66 consisting of a blind hole which is coaxial with the through hole 64 and has a same diameter as the through hole 64.

Figure 10:
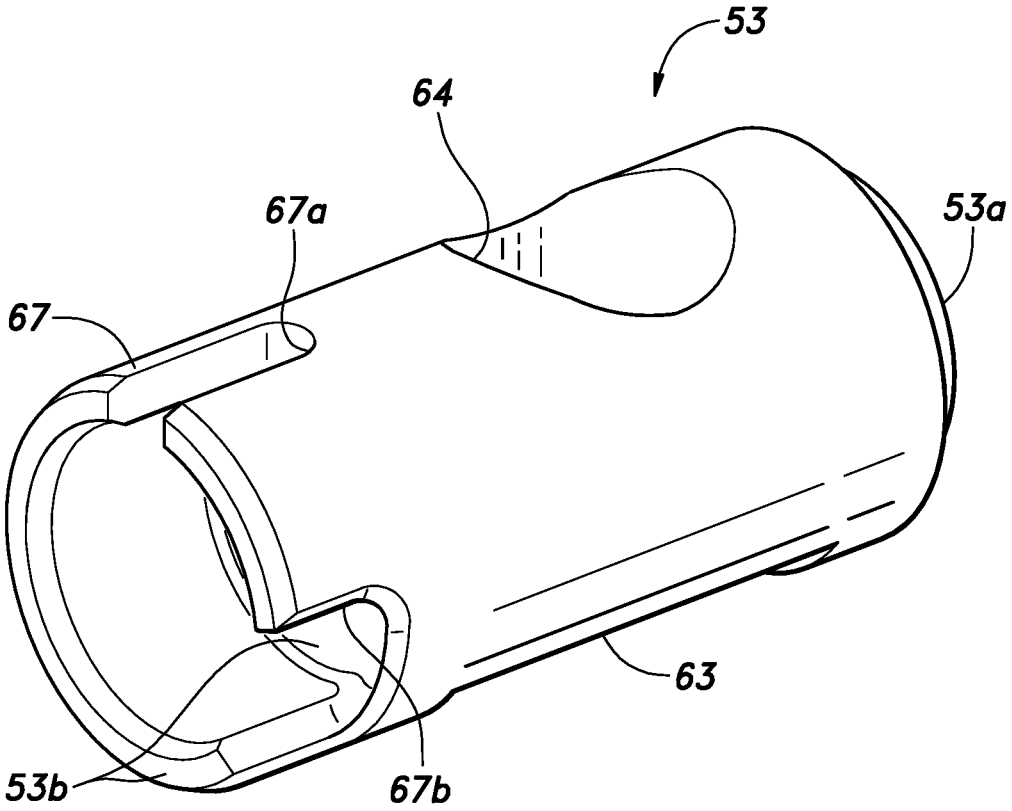
FIG. 10 is a perspective view of a switching pin.

FIG. 10 is a perspective view of the switching pin 53. As shown in FIGS. 7 and 10, the end of the switching pin 53 on the side of the second pressure receiving surface 53*b* is formed with a cylindrical wall 67 internally defining a recess for receiving the compression coil spring 61. When the switching pin 53 is displaced toward the valve operating chamber 57, the axial end of the cylindrical wall 67 abuts the bottom end surface of the pin receiving chamber 52. The upper side of the cylindrical wall 67 is formed with a slot 67*a* which receives a guide screw 68 threaded into the pin receiving chamber 52 through the upper wall of the pin receiving portion 54 so that the switching pin 53 is prevented from rotating in the pin receiving chamber 52.

As shown in FIGS. 6 and 10, a lower part of the cylindrical wall 67 is formed with a notch 67*b* for maximizing the cross sectional area of the passage communicating the valve operating chamber 57 with the valve operating recess 57*a*.

Figure 11A:
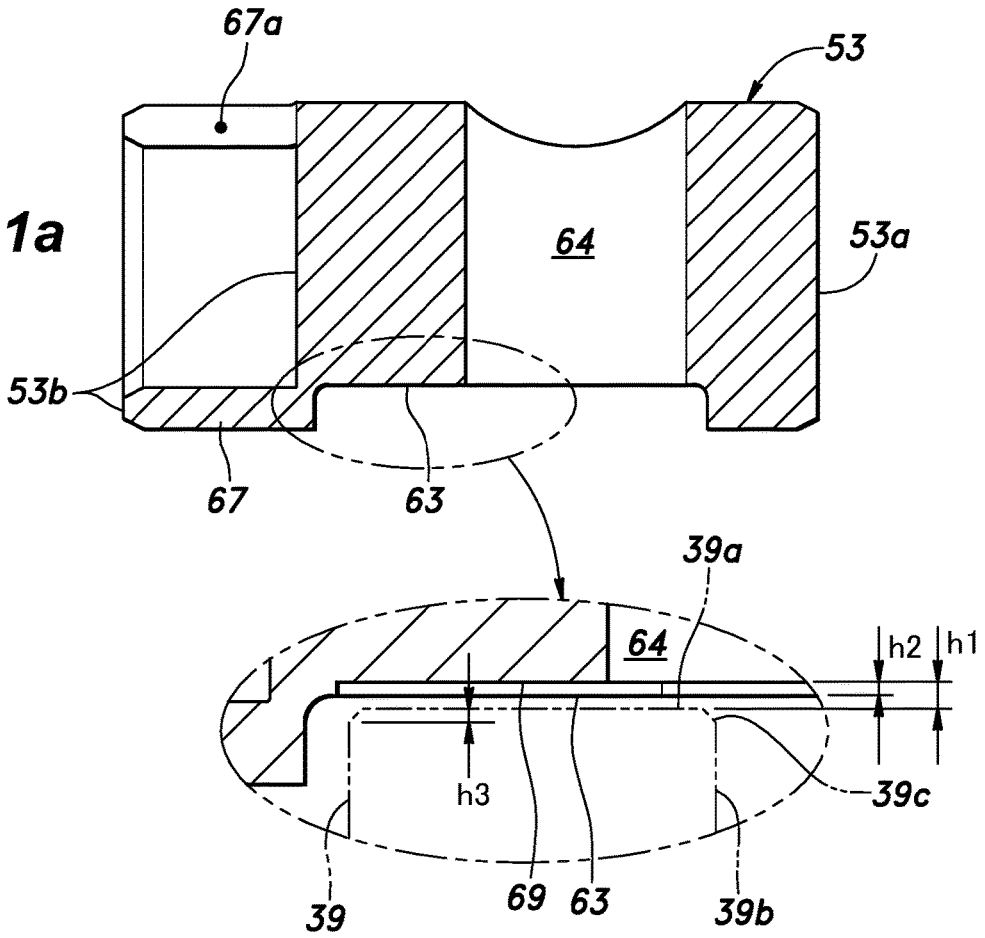
FIG. 11*a* is a longitudinal sectional view of the switching pin.
Figure 11B:
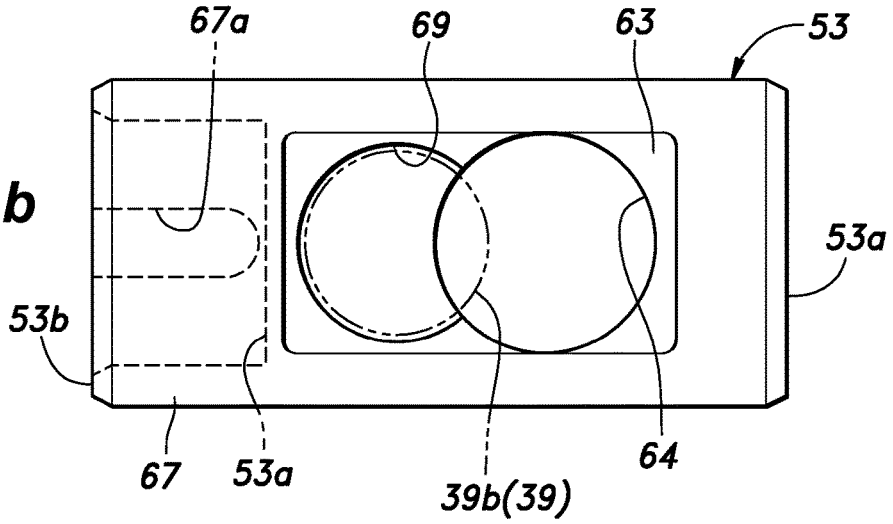
FIG. 11*b* is a bottom view of the switching pin.

FIG. 11*a* is a longitudinal sectional view of the switching pin 53, and FIG. 11*b* is a bottom view of the switching pin 53. As shown in FIGS. 11*a* and 11*b*, the part of the abutting surface 63 of the switching pin 53 that opposes the end surface of the stem end 39 is formed as a flat bottomed recess 69 slightly recessed (by dimension h2) with respect to the general surface plane of the abutting surface 63.

When the valve lifter 24 is in the base position (the engine valve 17 is closed) and the switching pin 53 is in the valve operating position, the end surface 39*a* of the stem end 39 is spaced from the bottom surface of the recess 69 by a dimension h1 which is greater than the dimension h2. The periphery of the end surface of the stem end 39 is either rounded or chamfered over a distance of h3 which is greater than the dimension h2.

When the valve lifter 24 is pushed down by the cam 21*a* via the rocker arm 22 in this state, the end surface 39*a* of the stem end 39 abuts the bottom surface of the recess 69. As a result, the engine valve 17 is driven in the opening direction via the valve lifter 24. On the other hand, when the switching pin 53 is in the valve rest position, the stem end 39 aligns with the through hole 64. Therefore, when the valve lifter 24 is pushed down by the cam 21*a* via the rocker arm 22, the stem end 39 is received in the through hole 64 so that no downward force is applied to the valve stem 32, and the engine valve 17 remains closed.

As shown in FIG. 7, an annular boss 73 protrudes downward from a middle part of the pin receiving portion 54 so as to engage the upper surface of the second cotter 45. When the stem end 39 moves into the through hole 64 of the switching pin 53, the annular boss 73 integral with the valve lifter 24 pushes down the second spring support portion 42 and causes the second spring support portion 42 to slide along the small diameter portion 40. When the valve lifter 24 is fully pushed downward, the stem end 39 is passed through the through hole 64, and received in the extension hole 66.

The four engine valves 17 of each cylinder are fitted with respective valve rest mechanisms, and the four valve rest mechanisms constitute a cylinder rest mechanism.

Figure 12B:
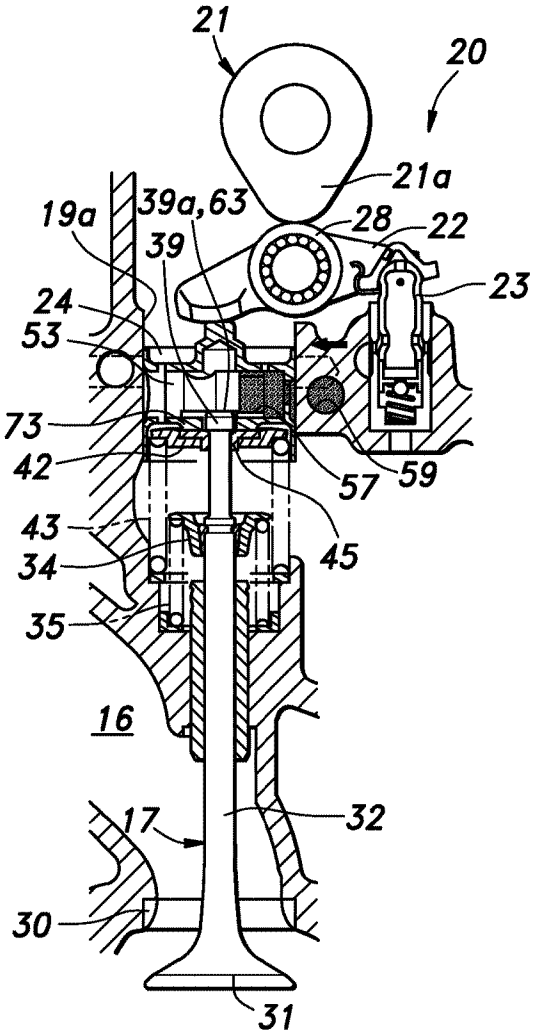
FIGS. 12*a*. 12*b*, 13*a* and 13*b* are fragmentary sectional views illustrating a mode of operation of the variable valve actuation device.
Figure 12A:
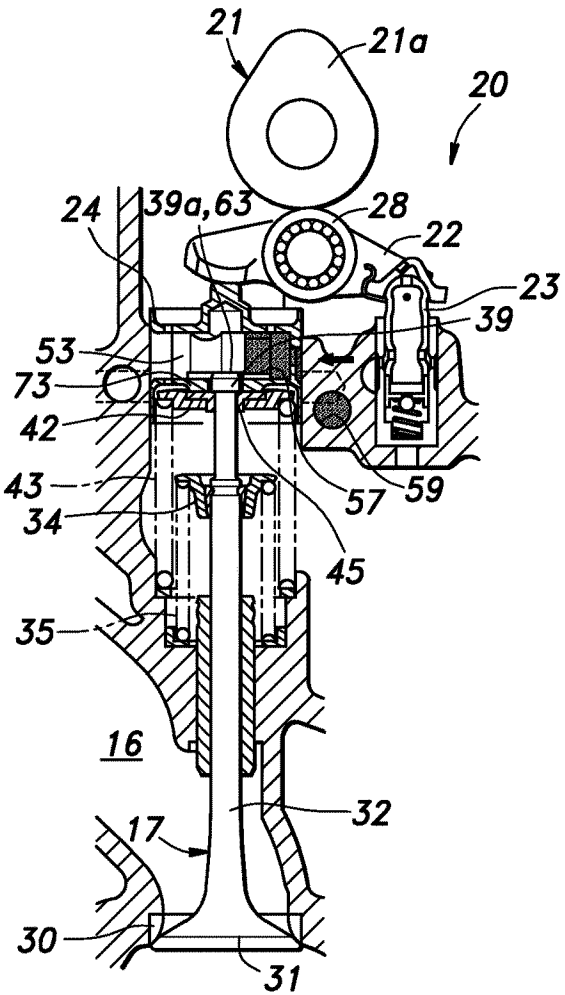

The mode of operation of the valve rest mechanism is described in the following with reference to FIGS. 12*a*, 12*b*, 13*a* and 13*b*. FIG. 12*a* shows the valve actuation device 20 when the valve lifter 24 is in the valve operating state, and the base part of the cam 21 engages the rocker arm 22, and FIG. 12*b* shows the valve actuation device 20 when the valve lifter 24 is in the valve operating state, and the cam 21 forces the valve lifter 24 downward via the rocker arm 22. It should be noted that the engine valve 17 is one of the exhaust valves 17E instead of the intake valves 171.

In the state shown in FIG. 17*a*, the abutting surface 63 of the switching pin 53 is positioned above the end surface 39*a* of the valve stem 32, and the engine valve 17 is urged in the valve closing direction by the first valve spring 35 engaged by the first spring support portion 34, and the second valve spring 43 engaged by the second spring support portion 42 so that the engine valve 17 is closed.

In the state shown in FIG. 17*b*, the valve lifter 24 is pushed down in the lifter support hole 19*a*, and the abutting surface 63 of the switching pin 53 pushes down the end surface 39*a* of the valve stem 32 so that the engine valve 17 also slides downward by a valve lift corresponding to the stroke of the valve lifter 24. As a result, the engine valve 17 opens.

When the valve lifter 24 descends, since the second cotter 45 abuts against the annular boss 73 of the valve lifter 24, the downward stroke of the valve lifter 24 is transmitted to the engine valve 17.

Figure 13B:
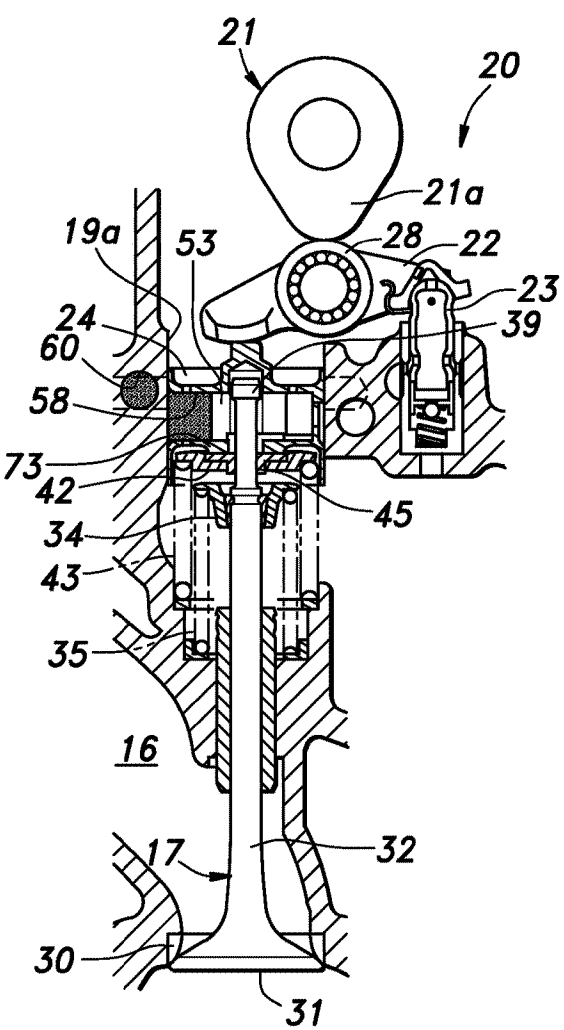
Figure 13A:
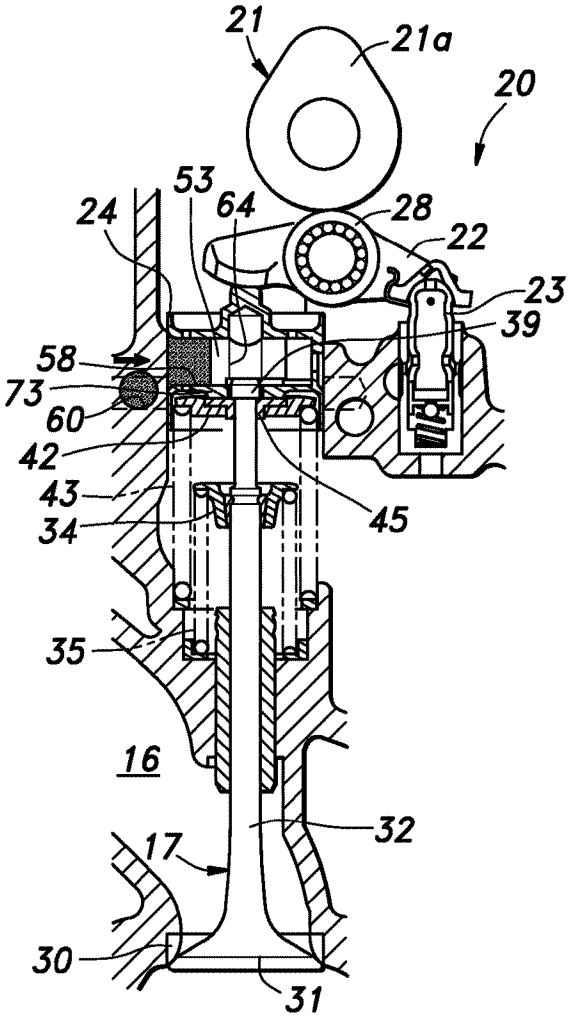

FIG. 13*a* shows the valve actuation device 20 when the valve lifter 24 is in the valve rest state, and the base part of the cam 21 engages the rocker arm 22, and FIG. 13*b* shows the valve actuation device 20 when the valve lifter 24 is in the valve rest state, and the cam 21 forces the valve lifter 24 downward via the rocker arm 22. It should be noted that the engine valve 17 is one of the exhaust valves 17E instead of the intake valves 171.

In the state shown in FIG. 13*a*, the abutting surface 63 of the switching pin 53 is positioned above the end surface 39*a* of the valve stem 32, and the engine valve 17 is urged in the valve closing direction by the first valve spring 35 engaged by the first spring support portion 34, and the second valve spring 43 engaged by the second spring support portion 42 so that the engine valve 17 is closed.

In the state shown in FIG. 17*b*, the valve lifter 24 is pushed down in the lifter support hole 19*a*, but the valve stem 32 is passed into the through hole 64 and then into the extension hole 66. Therefore, the engine valve 17 receives no downward force so that the engine valve 17 remains closed. In this case, the engine valve 17 is urged in the valve closing direction only by the first valve spring 35 engaged by the first spring support portion 34 while the second valve spring 43 engaged by the second spring support portion 42 does not apply a valve closing force to the engine valve 17.

Figure 14A:
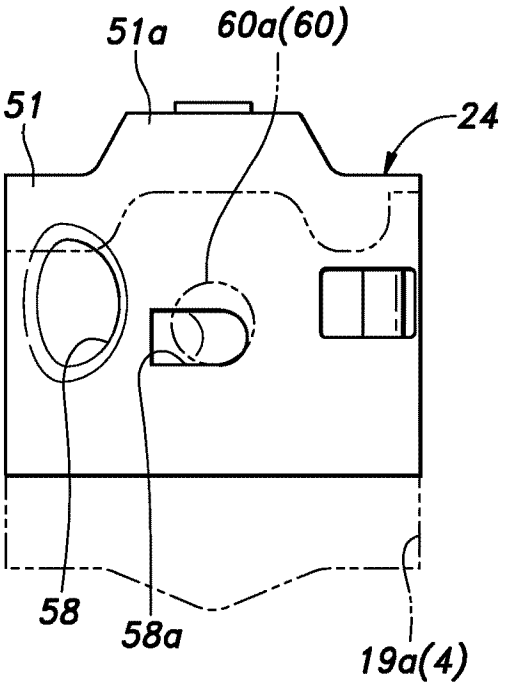
FIGS. 14*a*, 14*b* and 14*c* are diagrams illustrating different states of communication between a valve rest passage and a valve rest chamber depending on the position of the valve lifter.
Figure 14B:
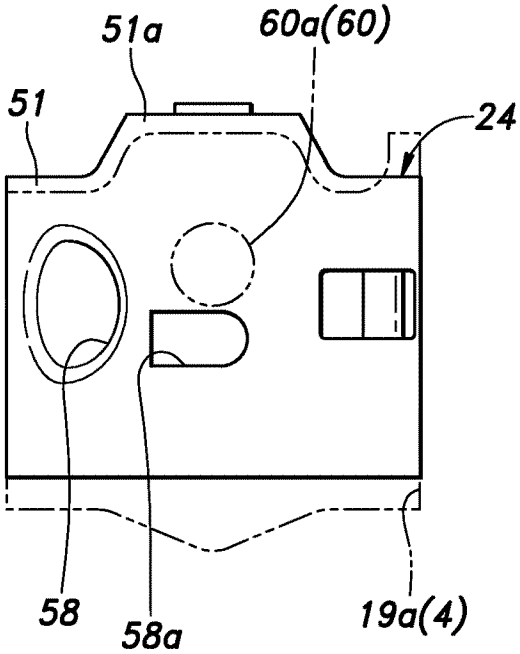
Figure 14C:
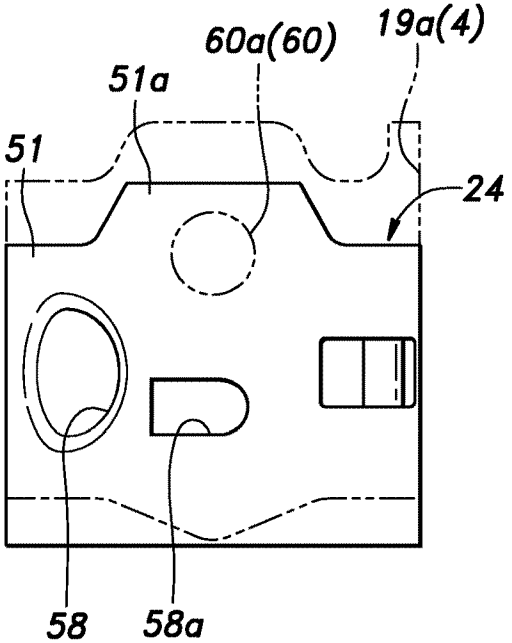

FIGS. 14*a* to 14*c* are explanatory views showing changes in the communication state between the valve rest passage 60 and the valve rest chamber 58 according to the displacement of the valve lifter 24 of the rear cylinder bank 2R. In FIGS. 14*a* to 14*c*, the valve lifter 24 is indicated by solid lines, and the lifter support hole 19*a* (the cylinder head 4) is indicated by imaginary lines. The same is true with FIGS. 15*a* to 15*c*.

FIG. 14*a* shows a state in which the valve lifter 24 is at the base position. The lower edges of the valve rest recess 58*a* and the valve rest supply port 60*a* align with each other so that the valve rest passage 60 and the valve rest chamber 58 fully communicate with each other. As the valve lifter 24 is displaced downward, the communication area between the valve rest passage 60 and the valve rest chamber 58 diminishes, but when the switching pin 53 is in the valve rest position, the pressure in the valve rest chamber 58 is maintained. However, when the switching pin 53 is in the process of moving from the valve operating position to the valve rest position, owing to the restriction imposed upon the oil flowing into the valve rest chamber 58, the pressure in the valve rest chamber 58 may be lower than the full pressure.

FIG. 14*b* shows a state in which the valve lifter 24 is at an intermediate position in the downward stroke thereof, and the valve rest recess 58*a* is positioned entirely below the valve rest supply port 60*a* so that the communication between the valve rest chamber 58 and the valve rest passage 60 severed. As a result, the hydraulic pressure in the valve rest chamber 58 is kept substantially constant. When the valve lifter 24 is pushed further down, the communication between the valve rest passage 60 and the valve rest chamber 58 remains disconnected.

FIG. 14*c* shows a state in which the valve lifter 24 is at the lowermost position in the downward stroke thereof, and the communication between the valve rest chamber 58 and the valve rest passage 60 remains disconnected. Furthermore, the valve rest supply port 60*a* is blocked by the extension wall 51*a*.

When the valve lifter 24 moves upward, the valve rest passage 60 and the valve rest recess 58*a* both remain blocked until the valve rest recess 58*a* and the valve rest supply port 60*a* start overlapping each other. Once the valve rest recess 58*a* and the valve rest supply port 60*a* at least partly overlap each other, supply of hydraulic pressure from the valve rest passage 60 to the valve rest chamber 58 is resumed.

Figure 15A:
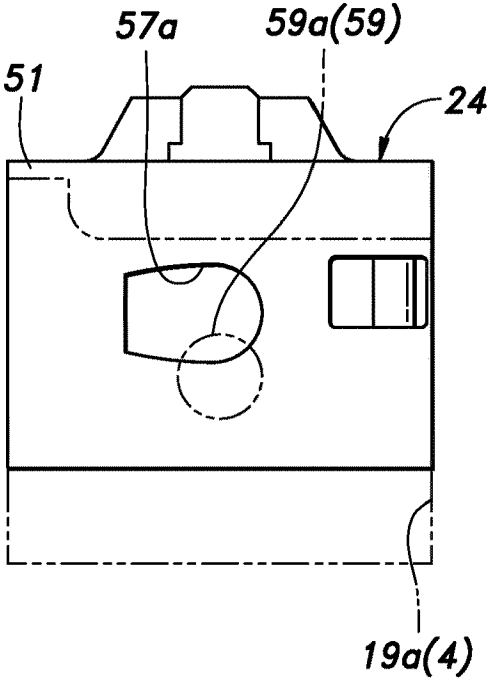
FIGS. 15*a*, 15*b* and 15*c* are diagrams illustrating different states of communication between a valve operating passage and a valve operating chamber depending on the position of the valve lifter.
Figure 15B:
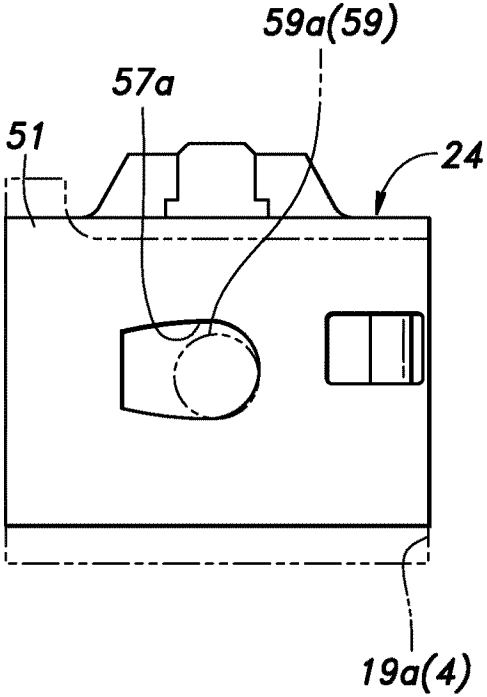
Figure 15C:
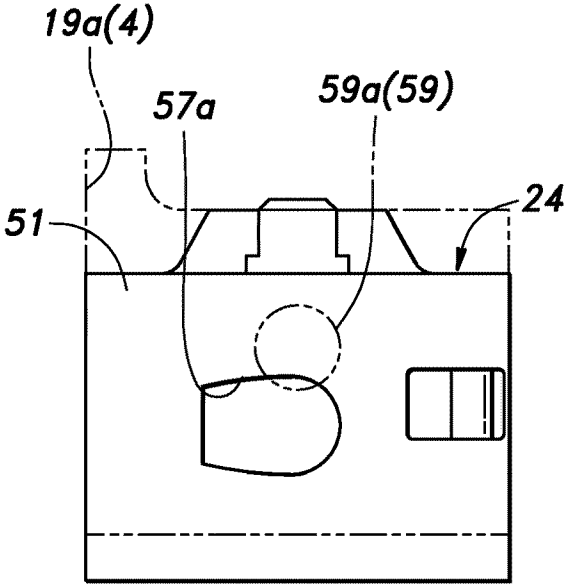

FIGS. 15*a* to 15*c* are explanatory views showing changes in the communication state between the valve operating passage 59 and the valve operating chamber 57 according to the displacement of the valve lifter 24 of the rear cylinder bank 2R.

FIG. 15*a* shows a state in which the valve lifter 24 is at the base position. The valve operating recess 57*a* overlaps with an upper part of the valve operating supply port 59*a* so that oil pressure can be supplied from the valve operating passage 59 to the valve operating supply port 59*a*. The upper edge of the valve operating recess 57*a* is located higher than the upper edge of the valve operating supply port 59*a*. Therefore, as the valve lifter 24 moves downward from this position, the area of communication between the valve operating recess 57*a* and the valve operating supply port 59*a* progressively increases.

FIG. 15*b* shows a state in which the valve lifter 24 is at an intermediate position in the downward stroke thereof, and the valve operating supply port 59*a* substantially completely overlaps with the valve operating recess 57*a*. As a result, the communication between the valve operating chamber 57 and the valve operating passage 59 is maximized. As the valve lifter 24 is further pushed downward, the communication between the valve operating chamber 57 and the valve operating passage 59 progressively diminishes.

FIG. 15*c* shows a state in which the valve lifter 24 is at the lowermost position in the downward stroke thereof, and the upper edge of the valve operating recess 57*a* substantially aligns with the lower edge of the valve operating supply port 59*a* (with a slight overlap) so that the communication between the valve operating chamber 57 and the valve operating passage 59 is minimized. At this time, the upper edge of the valve operating supply port 59*a* is lower than the upper edge of the outer peripheral wall 51 so that the operating supply port 59*a* is closed by the wall surface of the lifter support holes 19*a* even though the extension wall 51*a* is not provided in this part of the peripheral wall 51.

When the switching pin 53 is in the valve operating position, even if the communicating area between the valve operating chamber 57 and the valve operating passage 59 is reduced, the oil pressure in the valve operating chamber 57 changes very little. When the switching pin 53 is in the process of moving from the valve rest position side to the valve operating side, the amount of oil flowing into the valve operating chamber 57 decreases due to the reduction in the communicating area, the hydraulic pressure in the valve operating chamber 57 decreases to a certain extent similarly as in the case of the valve rest chamber 58 discussed earlier with reference to FIG. 14.

Figure 16:
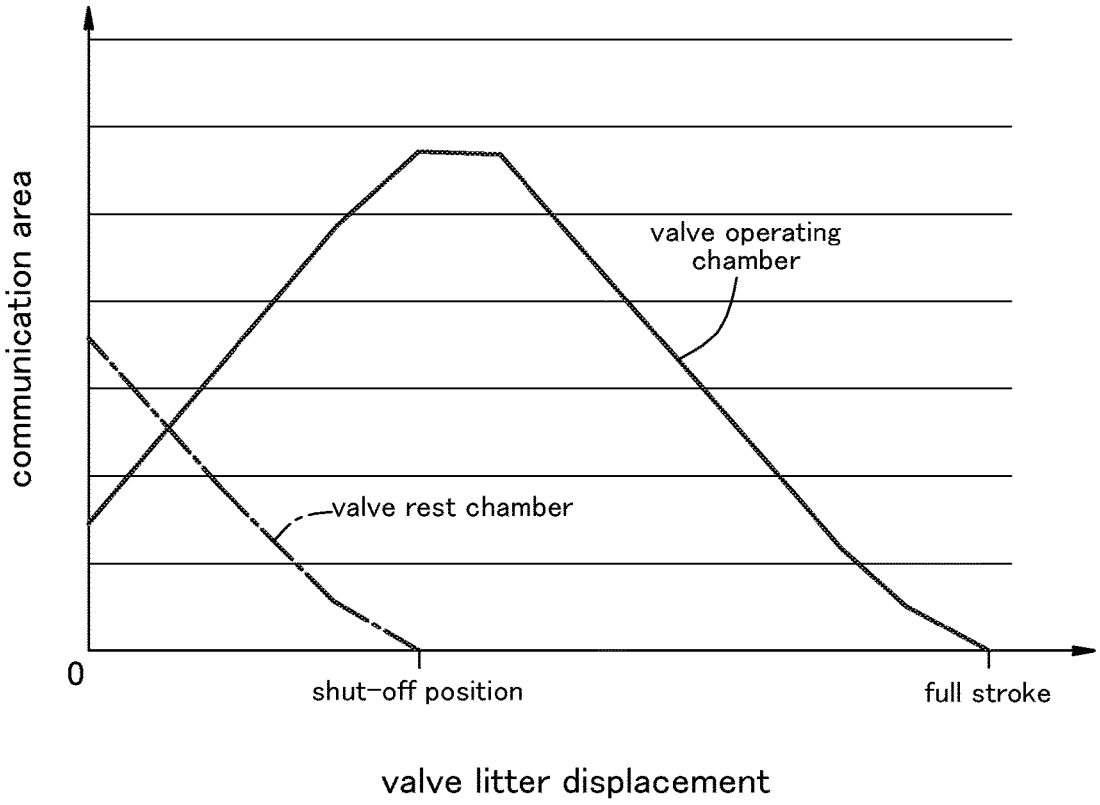
FIG. 16 is a graph showing the relationship between the position of the valve lifter and an effective cross sectional area of a passage.

FIG. 16 is a diagram showing the relationship between the stroke of the valve lifter 24 and the passage communication area, with the abscissa representing the stroke of the valve lifter 24 and the ordinate representing the passage communication area. The solid line curve indicates the passage communication area for the valve rest chamber 58 and the chain-dot line curve indicates the passage communication area for the valve operating chamber 57. The passage communication area for the valve rest chamber 58 is the largest when the stroke of the valve lifter 24 is zero, and progressively decreases with the increase in the stroke of the valve lifter 24. The passage communication area for the valve rest chamber 58 becomes zero at a certain point (shut-off point) in the downward stroke, and continues to be zero from this point onward until the valve lifter 24 reaches the lowermost position. In the illustrated embodiment, the point at which the passage communication area becomes zero is selected at one third of the downward stroke of the valve lifter 24 as measured from the uppermost position.

The passage communication area for the valve operating chamber 57 is a certain small value when the stroke of the valve lifter 24 is zero, and increases as the stroke of the valve lifter 24 increases from 0. The passage communication area reaches a maximum value when the stroke becomes near the shut-off point for the passage communication area for the valve rest chamber 58. Thereafter, as the stroke of the valve lifter 24 increases, the passage communication area of the valve operating chamber 57 decreases, and when the valve lifter 24 reaches the lowermost point in the downward stroke thereof, the passage communication area of the valve operating chamber 57 becomes substantially zero.

The mode of operation of the valve actuation device 20 on the side of the rear cylinder bank 2R provided with the valve rest mechanism is described in the following.

The control unit of the engine supplies oil pressure to the valve operating passage 59 and the valve rest passage 60 in a selective and mutually exclusive manner. When the oil pressure is supplied to the valve operating passage 59, the switching pin 53 is displaced toward the valve rest chamber 58 so that the abutting surface 63 of the switching pin 53 engages the stem end 39 of the engine valve 17 at all times, and the engine valve 17 is opened every time the valve lifter 24 is pushed downward.

Similarly, when the oil pressure is supplied to the valve rest passage 60, the switching pin 53 is displaced toward the valve operating chamber 57 so that the stem end 39 of the engine valve 17 is received in the through hole 64 as the valve lifter 24 is pushed downward. As a result, the engine valve 17 is kept closed without regard to the downward stroke of the valve lifter 24.

According to the prior valve rest mechanism, if the supply of oil to the valve operating passage 59 and the valve rest passage 60 is switched during the downward or upward stroke of the valve lifter 24, the switching pin 53 is caused to move between the valve operating position and the valve rest position during the upward or downward stroke of the switching pin 53. As a result, it is possible for the valve stem to be moved into the through hole when the valve lifter 24 is moving upward or downward. Similarly, it is possible for the switching pin 53 to be pushed from the valve rest position to the valve operating position when the valve lifter 24 is moving upward or downward even though the valve stem may still be received in the through hole 64. In either case, the operation of the valve actuation mechanism cannot be performed in a smooth manner, possibly causing noises, excessive wears and/or unstable operation of the engine.

This problem can be eliminated according to the present invention. Suppose that during the downward stroke of the valve lifter 24 in the valve operating state, the valve operating passage 59 ceases to receive the supply of oil pressure, and the valve rest passage 60 starts receiving the supply of oil pressure. Since the communication between the valve rest passage 60 and the valve rest chamber 58 becomes progressively limited once the valve lifter 24 starts moving downward, and is severed once the valve lifter 24 has moved downward by more than one third of the entire stroke (the shut-off position), the transition from the valve operating state to the valve rest state can be effected in a smooth manner. This state is maintained even during the upward stroke until the valve lifter 24 has moved up beyond the shut-off position.

Conversely, suppose that during the downward stroke of the valve lifter 24 in the valve rest state, the valve rest passage 60 ceases to receive the supply of oil pressure, and the valve operating passage 59 starts receiving the supply of oil pressure. In this case, since the communication between the valve rest passage 60 and the valve rest chamber 58 becomes progressively limited once the valve lifter 24 starts moving downward, and is severed once the valve lifter 24 has moved downward by more than one third of the entire stroke (the shut-off position), the oil in the valve rest chamber 58 is kept trapped in the valve rest chamber 58, and prevents the switching pin 53 from moving from the valve rest position, in spite of the pressure supplied to the valve operating chamber 57. Once the valve lifter 24 has moved up to a point near the uppermost position thereof (the shut-off position), the valve rest chamber 58 becomes communicated with the valve rest passage 60 so that the oil in the valve rest chamber 58 is allowed to be released, and the switching pin 53 is allowed to move to the valve operating position. Thus, the transition from the valve rest state to the valve operating state can be effected in a smooth manner.

As shown in FIG. 6, the pin receiving chamber 52 is formed as a blind hole drilled from the side of the valve rest chamber 58 so that the pin receiving chamber 52 along with an end wall for supporting the compression coil spring 61 can be formed in a simple and efficient manner. The end of the pin receiving chamber 52 on the side of the valve rest chamber 58 can be conveniently closed by the wall surface of the lifter support hole 19*a*. The displacement of the switching pin 53 toward the valve rest chamber 58 is limited by the stopper pin 62 which is installed after the switching pin 53 is received in the pin receiving chamber 52.

The axial line of the pin receiving chamber 52 is at an angle to the fore and aft direction of the vehicle whereas the valve operating passage 59 and the valve rest passage 60 are aligned to the fore and aft direction. Thus, the valve operating passage 59 and the valve rest passage 60 can be formed by a single drilling process from the outer side of the corresponding cylinder bank. The communication between the valve operating passage 59 and the valve operating chamber 57 can be achieved via the valve operating recess 57*a* and the valve operating communication passage 57*b* which are formed in the circumferential extension of the pin receiving portion 54 extending in the circumferential direction from the corresponding end of the pin receiving portion 54. Similarly, the communication between the valve rest passage 60 with the valve rest chamber 58 can be achieved via the valve rest recess 58*a* and the valve rest communication passage 58*b* which are formed in the circumferential of the pin receiving portion 54 extending in the circumferential direction from the corresponding end of the pin receiving portion 54.

As shown in FIG. 11, the part of the abutting surface 63 of the switching pin 53 corresponding to the end surface 39*a* of the stem end 39 when the switching pin 53 is in the valve operating position is formed with a recess 69 having a flat bottom surface (and a vertical dimension h2). The periphery of this recess 69 is defined by a circle coaxial to the valve stem 32 and slightly greater in diameter than the valve stem 32. When the switching pin 53 is in the valve operating position and the valve lifter 24 is in the base position, a slight gap (having a dimension h1) is created between the bottom surface of this recess 69 and the end surface 39*a* of the stem end 39. Therefore, when the valve lifter 24 is in the base position, the switching pin 53 can move between the valve operating position to the valve rest position without encountering any resistance from the stem end 39.

When the switching pin 53 is in the valve operating position and the valve lifter 24 is being pushed downward by the rocker arm 22, the stem end 39 is received in this recess 69. Therefore, at such a time, the engagement between the recess 69 and the stem end 39 resists the movement of the switching pin 53 from the valve operating position to the valve rest position. Therefore, the switching of the valve operating state to the valve rest state during the downward or upward movement of the valve lifter 24 can be avoided. Thereby, an unstable operation of the valve rest mechanism can be avoided. The chamfer or bevel at the end surface 39*a* of the stem end 39 (having a vertical dimension of h3) contributes to the smooth operation of the valve rest mechanism at all times.

As shown in FIG. 4, the rollers 28 of the rocker arms 22 that are engaged by the respective cams 21*a* have an axial line X' which is at a slight angle to the axial line of the corresponding camshafts 21. Therefore, the camshaft 21 receives an axial force as a result of the rolling engagement between the rollers 28 and the corresponding cams 21*a* so that the axial play of the camshaft 21 can be eliminated.

Although the present invention has been described in terms of a preferred embodiment thereof, it is obvious to a person skilled in the art that various alterations and modifications are possible without departing from the scope of the present invention. For instance, the foregoing embodiment was directed to a variable valve actuation device configured to selectively perform a full valve rest operation, but the present invention may also be applied to a variable valve actuation device configured to selectively perform a variable valve lift operation whereby the lift of the valve may be selectively varied over a range selected from 0% to 100%, or a valve variable valve actuation device configured to vary the timing of the lift of the engine valves. The type of the engine to which the invention may be applied is not limited to a DOHC engine, but also any other types of engines such as SOHC and OHV engines. The valve actuation device may use a see-saw type rocker arm, instead of the swing arm type rocker arm, and may also consist of a direct drive mechanism which does away with a rocker arm by causing the cam to act directly upon the cam lifter.

The invention claimed is:

1. A variable valve actuation device for an internal combustion engine, comprising:

an engine valve including a valve head configured to selectively close an intake port or an exhaust port of a combustion chamber of the engine, and a valve stem slidably provided on a cylinder head of the engine, and configured to be actuated by a cam of a camshaft;

a valve lifter slidably received in a lifter support hole formed in the cylinder head so as to be slidable between an upper position and a lower position, and interposed between the cam and the engine valve;

a switching member provided in the valve lifter so as to be movable under hydraulic pressure between a valve operating position where the switching member engages an end surface of the valve stem so as to drive the engine valve under a drive force of the cam and a valve rest position where the switching member is prevented from engaging the end surface of the valve stem so as to keep the engine valve at least partly closed;

a valve rest chamber defined in the valve lifter partly by a first pressure receiving surface of the switching member and provided with a valve rest communication passage opening out in a valve rest recess formed at an outer circumferential surface of the valve lifter; and a valve rest passage formed in the cylinder head and having a valve rest supply port opening out at an inner circumferential surface of the lifter support hole;

wherein the valve rest recess and the valve rest supply port are positioned such that the valve rest passage and the valve rest chamber communicate with each other when the valve lifter is at the upper position thereof, and continue to communicate with each other until the valve lifter has moved downward in the lifter support hole to a shut-off position located at a prescribed part of an entire down stroke thereof from the upper position thereof, a communication between the valve rest passage and the valve rest chamber being shut off at the shut-off position.

2. The variable valve actuation device according to claim 1, wherein a communication area between the valve rest passage and the valve rest chamber is maximized when the valve lifter is at the upper position thereof.

3. The variable valve actuation device according to claim 2, wherein the communication area between the valve rest passage and the valve rest chamber progressively decreases as the valve lifter moves downward from the upper position thereof.

4. The variable valve actuation device according to claim 1, wherein the valve lifter internally defines a switching pin receiving chamber extending diametrically therein, and the switching member comprises a switching pin slidably received in the switching pin receiving chamber, the valve rest chamber being defined by a part of the switching pin receiving chamber which is faced by a first end surface of the switching pin defining the first pressure receiving surface.

5. The variable valve actuation device according to claim 4, wherein the valve lifter comprises an outer peripheral wall defining a cylindrical outer profile and a switching pin receiving portion extending diametrically between opposing parts of the outer peripheral wall, the switching pin receiving chamber extending in the switching pin receiving portion along an axial direction thereof.

6. The variable valve actuation device according to claim 5, wherein an end part of the switching pin receiving portion is provided with a circumferential extension, and the valve rest communication passage extends circumferentially in the circumferential extension from an end of the valve rest chamber to the valve rest recess, the valve rest recess being circumferentially offset from an axial center line of the valve rest chamber and corresponding to the valve rest supply port.

7. The variable valve actuation device according to claim 6, wherein an axial line of the switching pin receiving chamber is at an angle to an axial line of the camshaft in plan view, and the valve rest supply port aligns with a diametric line of the cam lifter extending in parallel with the axial line of the camshaft.

8. The variable valve actuation device according to claim 5, wherein the outer peripheral wall of the valve lifter is provided with an extension wall extending upward from an upper edge of a part of the outer peripheral wall corresponding to the valve rest supply port of the cylinder head with respect to a circumferential direction of the valve lifter.

9. The variable valve actuation device according to claim 4, further comprising:

a valve operating chamber defined in the valve lifter by a part of the switching pin receiving chamber which is faced by a second end surface of the switching pin defining a second pressure receiving surface and provided with a valve operating communication passage communicating with a valve operating recess opening out at an outer circumferential surface of the valve lifter; and a valve operating passage formed in the cylinder head and having a valve operating supply port opening out at an inner circumferential surface of the lifter support hole;

wherein the valve operating recess and the valve operating supply port are positioned such that the valve operating passage and the valve operating chamber communicate with each other substantially over an entire vertical stroke of the valve lifter.

10. The variable valve actuation device according to claim 9, wherein the valve operating communication passage and the valve operating supply port are positioned such that a communication area between the valve operating passage and the valve operating chamber communicate is maximized substantially when the valve lifter is at the shut-off position.

11. The variable valve actuation device according to claim 9, wherein the switching pin receiving chamber is provided with an open end and a closed end remote from the open end, the valve operating chamber being defined by the closed end of the switching pin receiving chamber and the second end of the switching pin, and the valve rest chamber being defined by the open end of the switching pin receiving chamber and the first end of the switching pin, and a compression coil spring is interposed between the closed end of the switching pin receiving chamber and the second end of the switching pin.

12. The variable valve actuation device according to claim 9, wherein the switching pin is provided with an abutting surface configured to abut the end surface of the valve stem of the engine valve, and a hole provided adjacent to the abutting surface and configured to receive the stem end of the engine valve.

13. The variable valve actuation device according to claim 12, wherein a certain gap is created between the abutting surface and the end surface of the valve stem when the switching pin is at the valve operating position and the valve lifter is at the upper position thereof.

14. The variable valve actuation device according to claim 13, wherein the abutting surface is provided with a flat bottomed recess configured to receive the stem end when the switching pin is at the valve operating position and the valve lifter is at the upper position, a depth of the flat bottomed recess being smaller than a vertical dimension of the certain gap.

15. The variable valve actuation device according to claim 14, wherein the stem end of the engine valve is provided with a chamfered or rounded portion having a vertical dimension greater than the depth of the flat bottomed recess.

16. The variable valve actuation device according to claim 1, wherein a rocker arm is interposed between the valve lifter and the cam of the camshaft, and the rocker arm is provide with a roller configured to be engaged by the cam, an axial line of the roller being slightly angularly offset relative to an axial line of the camshaft.

* * * * *